US005518323A

United States Patent [19]

Sakaino et al.

[11] Patent Number: 5,518,323

[45] Date of Patent: May 21, 1996

[54] METHOD OF ADJUSTING A HEAD GAP FOR A WIRE DOT IMPACT PRINTER

[75] Inventors: Hiroshi Sakaino; Hideaki Ishimizu; Mitsuru Kishimoto; Noboru Ooishi; Masayuki Ishikawa; Chihiro Komori; Naoji Akutsu; Jiro Tanuma; Tadashi Kasai, all of Tokyo, Japan

[73] Assignee: Oki Electric Industry Co., Ltd., Tokyo, Japan

[21] Appl. No.: 91,210

[22] Filed: Jul. 14, 1993

[30] Foreign Application Priority Data

Jul. 17, 1992 [JP] Japan ..... 4-190315
Dec. 11, 1992 [JP] Japan ..... 4-330816

[51] Int. Cl.[6] ..... B41J 2/30

[52] U.S. Cl. ..... 400/55; 400/56; 400/124.04; 400/124.05

[58] Field of Search ..... 400/55, 56, 57, 400/58, 124.04, 124.05; 347/8

[56] References Cited

U.S. PATENT DOCUMENTS 4,907,901 3/1990 Mitchell ..... 400/55
5,088,842 2/1992 Ito et al. ..... 400/59
5,156,464 10/1992 Sakai ..... 400/55
5,204,537 4/1993 Bennet et al. ..... 400/56
5,205,658 4/1993 Iriguchi ..... 400/55

FOREIGN PATENT DOCUMENTS 306069 12/1988 Japan ..... 400/55
4-135761 5/1992 Japan ..... 400/55

*Primary Examiner*—John S. Hilten
*Attorney, Agent, or Firm*—Spencer & Frank

[57] ABSTRACT

According to a method of adjusting a head gap, a wire dot head is set to a predetermined position of a reference head gap; a printing pattern for detecting printing time is printed by a plurality of pins; reference printing times of respective pins are detected. Next, a test printing is performed with test printing dots previously selected from printing data, and printing time of the test printing is detected. Then, the thickness of the printing media is calculated based on the reference printing time and the printing time of the test printing. At that time, a rule of thumb in which the difference of the printing time corresponds to the difference of the head gap, is used. Then, a shift amount of the wire dot head is calculated for setting the head gap to an optimum value according to the thickness of the printing media, and gap shifting mechanism shifts the wire dot head by the shift amount. This leads to highly accurate detection of the head gap and improves printing quality thereof.

15 Claims, 28 Drawing Sheets

FIG. 35
(CONVENTIONAL)
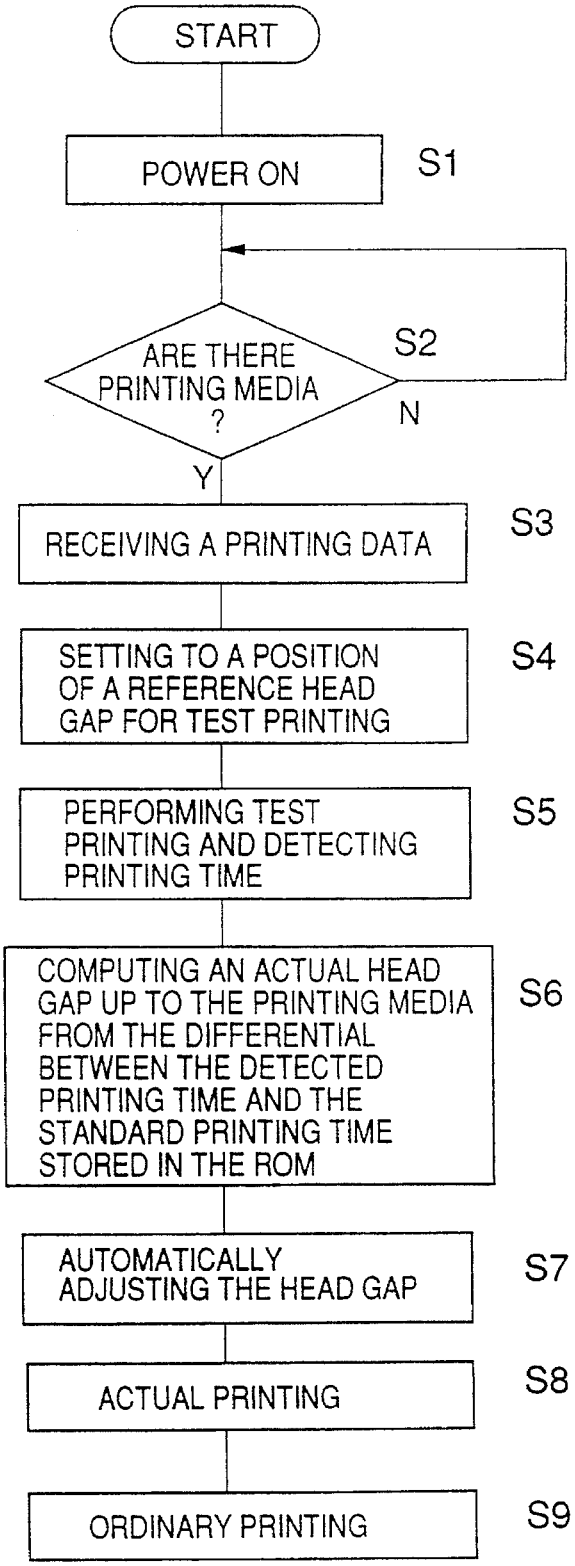

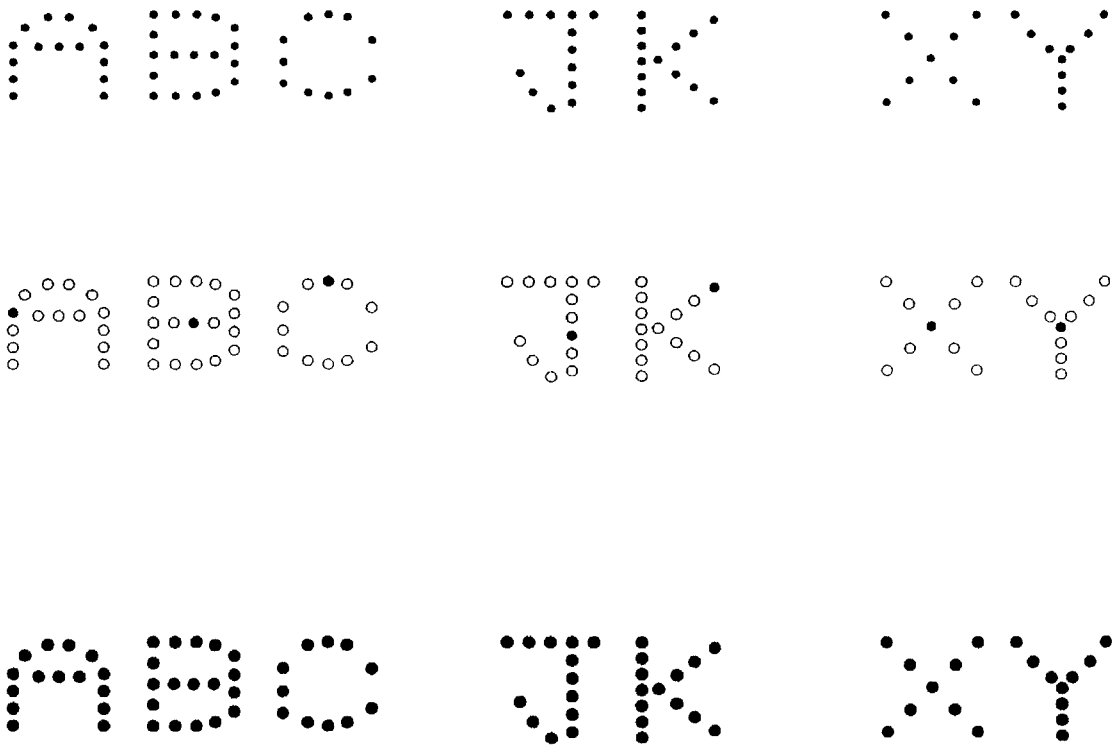
FIG.36
(CONVENTIONAL)
36(a) 36(b) 36(c)

METHOD OF ADJUSTING A HEAD GAP FOR A WIRE DOT IMPACT PRINTER

BACKGROUND OF THE INVENTION

1. Field of the Invention

This invention relates to a method of adjusting a head gap for a wire dot impact printer and, more particularly, to a method of adjusting a head gap capable of automatically obtaining an optimum value of the gap corresponding to the characteristics of a wire dot head.

2. Description of Related Art

In a conventional wire dot impact printer, a wire dot head is disposed so as to oppose a platen through an ink ribbon and printing media, and prints onto the printing media by impacting the ink ribbon with printing wires. Such a wire dot impact printer of this kind can use printing media of various types and can adjust the distance between the tip of the wire dot head and the printing media, or a head gap, to an optimum value when the thickness of the printing media or a number of sheets, in the case of copy paper, is changed due to changes of the printing media or the like.

FIG. 35 is a flow chart showing a conventional method of adjusting a head gap for a wire dot impact printer; FIG. 36 is a diagram showing a printing sample of the conventional method of adjusting the head gap for the wire dot impact printer. In FIG. 36, (*a*) is a diagram showing printing data in a first line of printing; (*b*) is a diagram showing a printing pattern of test printing; (*c*) is a diagram showing a printing pattern of re-printing.

Referring to FIG. 35, the power of the wire dot impact printer is turned on at step S1. At step S2, a judgment is made as to whether or not there are printing media, and if there are, the program goes to step S3, or if there are not, the program waits for the media. Then, printing data from a host computer (not shown) is received at step S3. The position of the wire head is set so that the head gap g becomes a reference head gap gA (for instance 0.5 mm) for test printing at step S4. Herein, the reference head gap gA is defined as a head gap g under a condition that an ink ribbon (not shown) and printing media P, whose thickness is previously known, are set, and a standard printing time $T_S$ is previously written in a table in a ROM. According to the printing data received, at step S5 a test printing, e.g., the printing of several dots to several tens of dots of a first printing line, is performed as shown in FIG. 36(*b*), and during the test printing, printing time T is detected. At step S6, the difference between the detected printing time T and the standard printing time Ts stored in the ROM is calculated. A difference Dg between the standard head gap gA and an actual head gap g is then calculated using the relationship where a difference of 3 μsec in the printing time T corresponds to a head gap g of 0.01 mm. The program step calculates based on the thickness of the printing media P at the time when the standard printing time Ts is determined, and the difference Δg, thereby finding the thickness of the printing media currently set. At step S7, the program step calculates a shifting amount of the wire dot head to shift the head gap g to an optimum value gR corresponding to the thickness of the printing media P, and automatically adjusts the head gap with driving means for changing gap. Then, an actual printing is performed for the line on which the test printing is done, as shown in FIG. 36(*c*), at step S8. Hereafter, an ordinary printing is done at step S9.

In the conventional method of adjusting the head gap for the wire dot impact printer as described above, however, it is difficult to adjust the head gap g accurately since there are deviations, by each wire dot head, in the standard printing time Ts in the ROM used for calculating the head gap g, and in the detected printing time T.

SUMMARY OF THE INVENTION

It is an object of the invention to provide a method of adjusting a head gap for a wire dot impact printer in which the problem in the conventional method of adjusting a head gap for a wire dot impact printer is solved, in which a printing time of a wire dot head currently mounted can be readily detected and memorized by the wire dot impact printer itself, and in which a high detection accuracy of the head gap and an improved printing quality are obtainable.

The foregoing object is accomplished with a method of adjusting a head gap for a wire dot impact printer in which: a wire dot head is set to a predetermined position of a reference head gap; a printing pattern is printed for detecting the printing time by a plurality of pins; standard printing times of respective pins are detected; a test printing is then done; a printing time on the test printing is detected; thickness of printing media is calculated based on the standard printing times and the printing time on the test printing; a shift amount of the wire dot head for shifting the head gap to an optimum value corresponding to the thickness of the printing media is calculated; finally, the wire dot head is shifted by the shift amount.

In another aspect of the invention, a method of adjusting a head gap for a wire dot impact printer includes the following steps. First, a wire dot head is set to a predetermined position of a reference head gap, and then a printing pattern for detecting a printing time is printed by a plurality of pins to detect a standard printing time of respective pins. Next, the wire dot head is set to a predetermined position of the head gap for first test printing. After the first test printing is done, a printing time of the first test printing is detected, and the thickness of the printing media is roughly calculated based on the standard printing time and the printing time of the first test printing. Consecutively, a head gap for second test printing narrower than the head gap for the first test printing is set according to the rough thickness of the printing media, and then, the wire dot head is set to a position of the head gap for the second test printing. After the second test printing is done, a printing time of the second test printing is detected, and the thickness of the printing media is calculated based on the standard printing time and the printing time of the second test printing. According to the thickness of the printing media, a shift amount of the wire dot head for shifting the head gap to an optimum value is calculated. Finally, the wire dot head is shifted only by the shift amount.

According to yet another aspect of the invention, a method of adjusting a head gap for a wire dot impact printer includes the following steps. First, a wire dot head is set to a predetermined position of a reference head gap, and a printing pattern is printed for detecting the printing time by a plurality of pins. Then, standard printing times of respective pins are detected, and an average value of the detected printing times is calculated to be stored in a memory. Next, a test printing is done, and a printing time of the test printing is detected. Thickness of the printing media is then calculated based on the average value of the printing time and the printing time of the test printing.

According to a preferred embodiment, extraordinary printing times are eliminated among the detected printing time obtained by the test printing, and the thickness of the printing media is calculated based on printing times except the extraordinary printing times. Moreover, the thickness of the printing media can be calculated only when the dot number of the test printing is equal to or greater than a predetermined value.

In accordance with further aspect of the invention, the speed of an armature is detected, and the returning time of printing wires is detected by a speed waveform of the detected speed and by a predetermined slice level. According to the returning time, the thickness of the printing media is calculated. In this case, after the returning time of the printing wires is detected by the speed waveform of the detected speed and by the predetermined slice level, the thickness of the printing media can be calculated based on the printing time and the returning time.

BRIEF DESCRIPTION OF THE DRAWINGS

The above and other objects and features of the invention are apparent to those skilled in the art from the following preferred embodiments thereof when considered in conjunction with the accompanied drawings, in which:

FIG. 35 is a flow chart showing a conventional method of adjusting a head gap for a wire dot impact printer; and FIGS. 36(*a*), 36(*b*) and 36(*c*) diagram showing a printing sample according to the conventional method of adjusting a head gap for a wire dot impact printer.

DETAILED DESCRIPTION OF THE PREFERRED EMBODIMENTS

Figure 1:
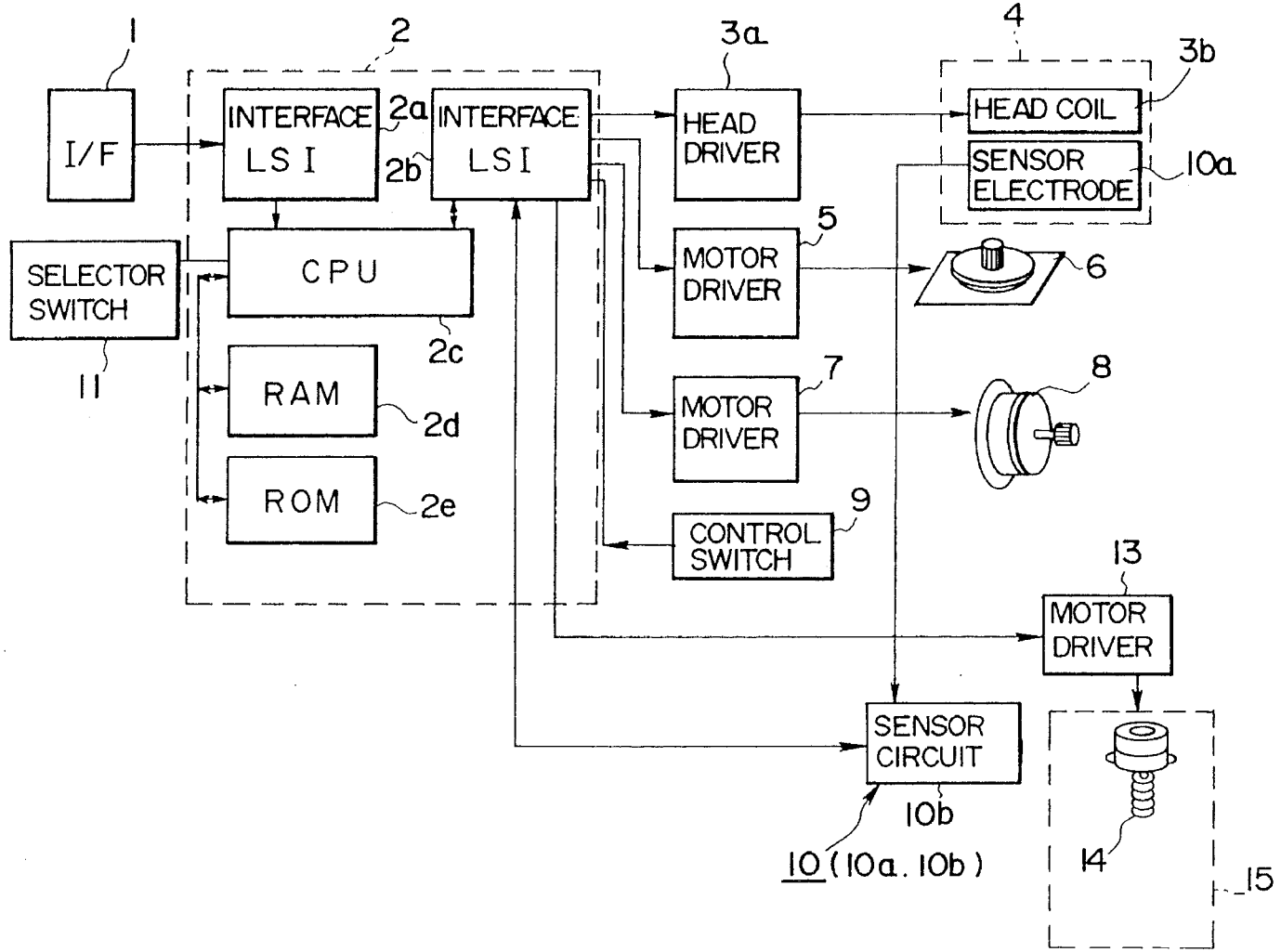
FIG. 1 is a block diagram illustrating a wire dot impact printer to which a method of adjusting a head gap according to the invention is applied.

Referring to the drawings in detail, in particular, to FIGS. 1 to 3, a wire dot impact printer to which a method of adjusting a head gap according to a preferred embodiment of the invention is applied will now be described.

FIG. 1 is a block diagram illustrating a wire dot impact printer to which a method of adjusting a head gap according to the invention is applied; FIG. 2 is a plan view showing gap shifting means of the wire dot impact printer; and FIG. 3 is a side view showing the gap shifting means. In FIG. 1, the wire dot impact printer includes a head driver 3*a* for driving a wire dot head 4 having a head coil 3*b*, a motor driver 5 for driving a spacing motor 6 for shifting the wire dot head 4 in a widthwise direction of the printing media, a motor driver 7 for driving a line feed motor 8 for feeding the printing media in a direction perpendicular to the widthwise direction, and a motor driver 13 for driving gap shifting means, or gap shifting mechanism, 15 having a pulse motor 14 for changing the head gap of the wire dot head. Those drivers 3*a*, 5, 7, 13 are respectively connected to a control circuit 2 for controlling operations of the entire printer. The control circuit 2 includes an interface LSI 2*a* for inputting printing data through an interface I/F 1, an interface LSI 2*b* for outputting the printing data, a CPU (Central Processing Unit) 2*c* for processing, such as for calculation of a head gap g from detected printing time T, a RAM (Random Access Memory) 2*d* used for a back-up memory for storing the printing data and an average value $T_{PA}$ of standard printing times Tp of respective pins, and a ROM 2*e* for storing control programs and print fonts. Moreover, the control circuit 2 is also connected to a selector switch 11 for selecting printing time detection mode, a control switch 9, and printing time detecting means 10 having sensor electrodes 10*a* provided at the wire dot head 4 and a sensor circuit 10*b*.

Figure 2:
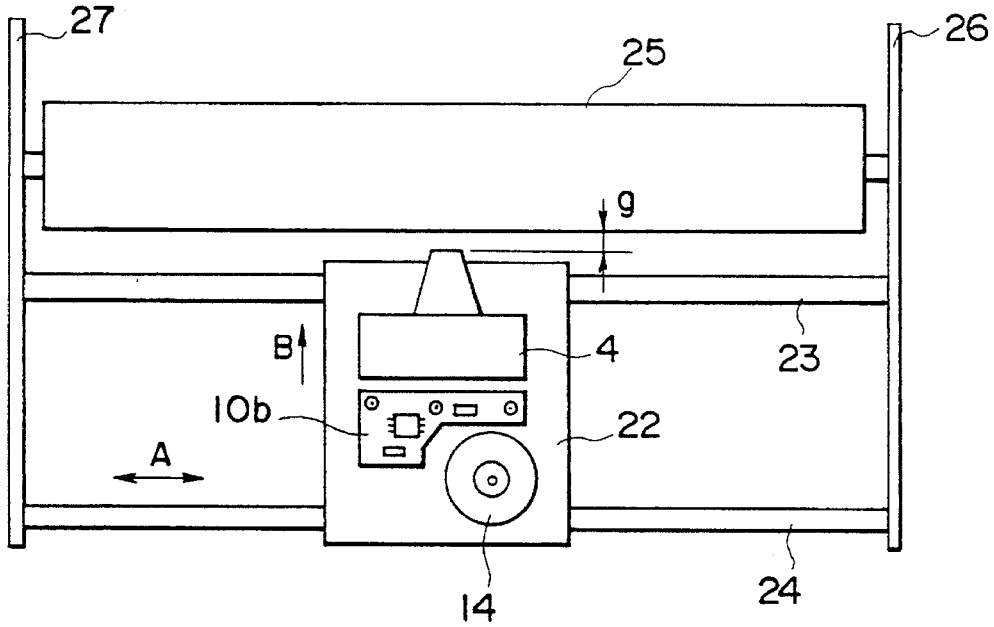
FIG. 2 is a plan view showing gap shifting means of the wire dot impact printer.
Figure 3:
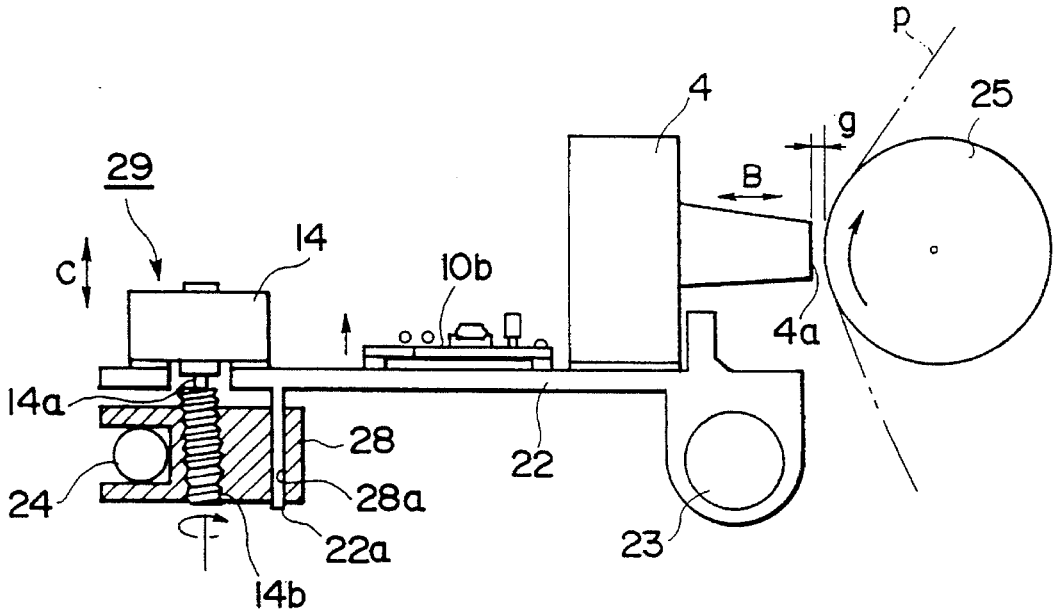
FIG. 3 is a side view showing the gap shifting means.

Referring to FIGS. 2 and 3, the wire dot head 4 is provided so as to be opposite to a platen 25 and is disposed on a carriage 22, which is supported on guide shafts 23, 24 arranged perpendicularly to side frames 26, 27 so as to be movable in the directions indicated by arrow A. The carriage 22 moves in the directions indicated by arrow A by receiving power from the spacing motor 6 shown in FIG. 1 and shifts the wire dot head 4 in a widthwise direction of the printing media P (FIG. 3). The platen 25 rotates by receiving power from the line feed motor 8 (FIG. 1) and conveys the printing media P in a lengthwise direction perpendicular to the widthwise direction. When printing, the wire dot head 4 moves in the widthwise direction of the printing media P with a predetermined speed and impacts, for example, an ink ribbon (not shown) at a printing position of the printing media P with printing wires (not shown). When reaching the end position of the printing media P and finishing printing of one line, the wire dot head 4 subsequently moves in an opposite direction to return to an initial position. At that time, the platen 25 rotates to feed the printing media P in the lengthwise direction by one line, and then, printing starts for the next line.

Although the carriage 22 moves along the pair of guide shafts 23, 24, a rear portion of the carriage 22 is supported by the guide shaft 24 through a level adjustment mechanism 29. That is, the rear portion of the carriage 22 is fixed to the pulse motor 14, whose spindle 14*a* directly couples with a screw gear 14*b*. A guide pin 22*a* is formed at a bottom face of the rear portion of the carriage 22 so as to protrude therefrom and is inserted, so as to be movable up and down, in a guide hole 28*a* of a slider 28 mounted on and being slidable along the guide shaft 24. The slider 28 is formed with a gear or gears not shown, which mesh with the screw gear 14*b*. Accordingly, the carriage 22 is supported on the guide shaft 24 through the slider 28, the screw gear 14*b*, the spindle 14*a*, and the pulse motor 14. When the pulse motor 14 is rotated, the rear portion of the carriage 22 moves up or down in the directions indicated by arrow C, namely, along the guide pin 22*a* guided by the guide hole 28*a*, thereby rotating the carriage 22 around the guide shaft 23 as an axis. According to this operation, a tip 4*a* of the wire dot head 4 shifts in backwards or forwards in the directions indicated by arrow B to change the head gap g formed between the tip 4*a* and the printing media P. It is to be noted that other means, for example, such as shifting the platen 25, in addition to what is described above, can be used as means for shifting the head gap g.

Next, the printing time detecting means 10 will be described.

Figure 4:
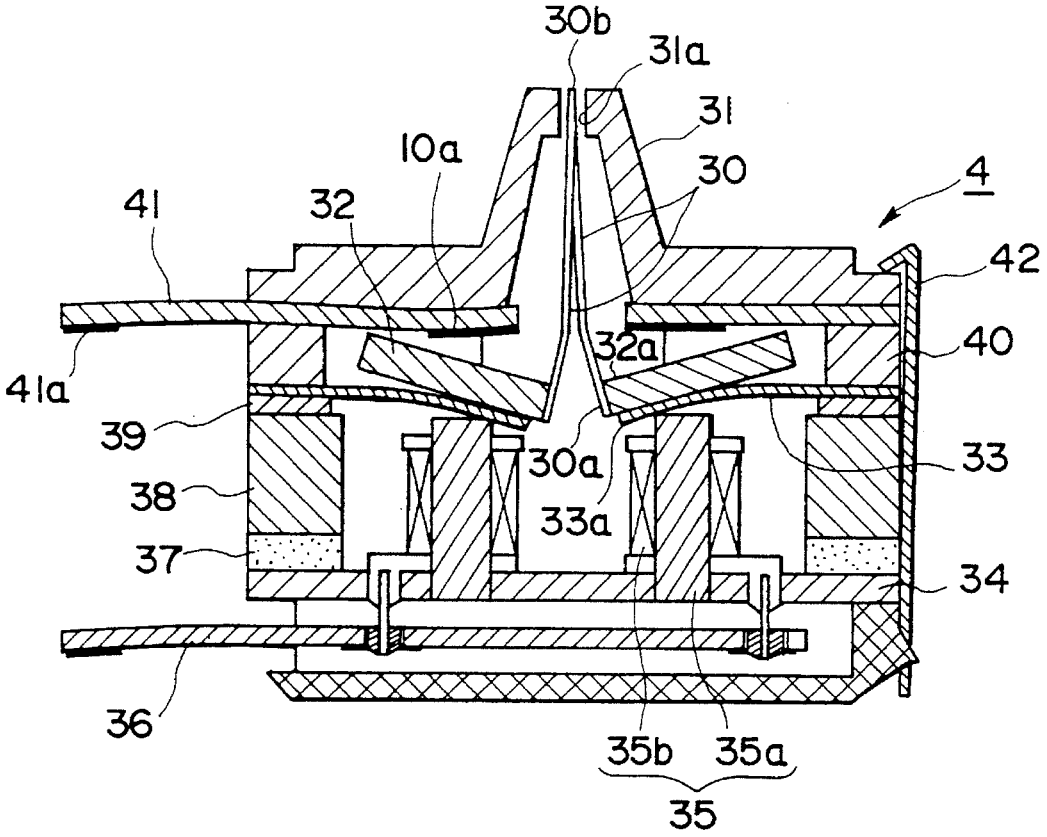
FIG. 4 is a vertical cross section showing a wire dot head of the printer.
Figure 5:
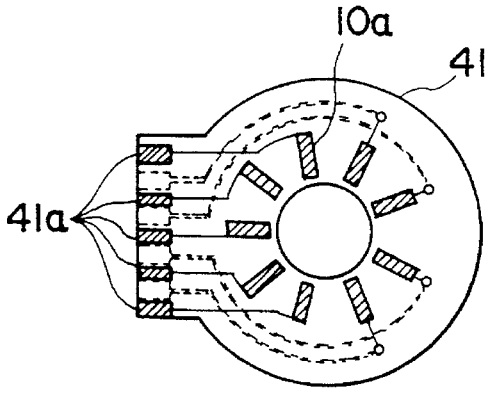
FIG. 5 is a plan view showing a printed board of the printer.
Figure 6:
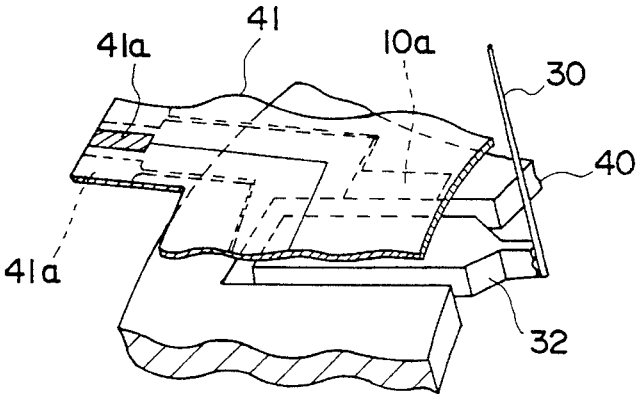
FIG. 6 is a perspective view showing an essential portion of the printed board.

FIG. 4 is a vertical cross section of the wire dot head 4; FIG. 5 is a plan view of a printed board; and FIG. 6 is a perspective view of an essential portion of the printed board. In FIG. 4, the wire dot head 4 is constituted of a plurality of printing wires 30 (only two are shown in FIG. 4) provided within the head, a front casing 31 having guide holes 31*a* for guiding the printing wires 30, a plurality of armatures 32 formed of a magnetic material, a plate spring 33 supporting the armature 32, a base plate 34, a plurality of electromagnets 35, each composed of a core 35*a* and a head coil 35*b* winding around the core 35*a*, a printed board 36 having a printed wiring for feeding current to the electromagnets 35 and a connector terminal, a permanent magnet 37, a base 38, a spacer 39, a yoke 40, a printed board 41, and a clamper 42. The clamper 42 clamps the base plate 34, the permanent magnet 37, the base 38, the spacer 39, the plate spring 33, the yoke 40, the printed board 41, and the front casing 31 while those elements are stacked one by one to be a unitary body. The armature 32 is supported on a side of an unfixed end 33*a* of the plate spring 33, and a proximal portion 30*a* of each printing wire 30 is jointed to a tip 32*a* of the armature 32. The tip 30*b* of the printing wire 30 is constituted so as to be guided by the guide hole 31*a* of the front casing 31 to impact printing media P. As shown in FIGS. 5 and 6, plural sensor electrodes 10*a* formed from a copper foil pattern are disposed at positions, corresponding to the armatures 32, of the printed board 41. These sensor electrodes 10*a* are connected to a connector terminal 41*a* provided at the edge of the printed board 41 through the printed wiring. The printed board 41 is coated with an insulating film for isolating the yoke 40. Therefore, static capacitance occurs between the sensor electrodes 10*a* and the armatures 32. The amount of the static capacitance becomes small as the spacing between them becomes wide, or the amount becomes large as the spacing between them becomes narrow.

In the wire dot head 4 thus constructed, when the head coil 35*b* is not energized, magnetic force of the permanent magnet 37 attracts the armature 32 toward the base plate 34, or downward in FIG. 4, in opposition to elastic power of the plate spring 33. If the head coil 35*b* is energized under this situation, the magnetic flux of the electromagnet 35 cancels the magnetic flux of the permanent magnet 37, thereby releasing the armature 32 from the attracting force of the permanent magnet 37, so that the armature 32 moves toward the front casing 31, or upward in FIG. 4, by elastic power of the plate spring 33. The printing wire 30 is then jutted through the guide hole 31*a* according to the motion of the armature 32, thereby impacting the printing media P to print. The yoke 40 is a part of a magnetic circuit formed by the electromagnet 35, and serves in cutting off mutual interference between the sensor electrodes 10*a*.

Figure 7:
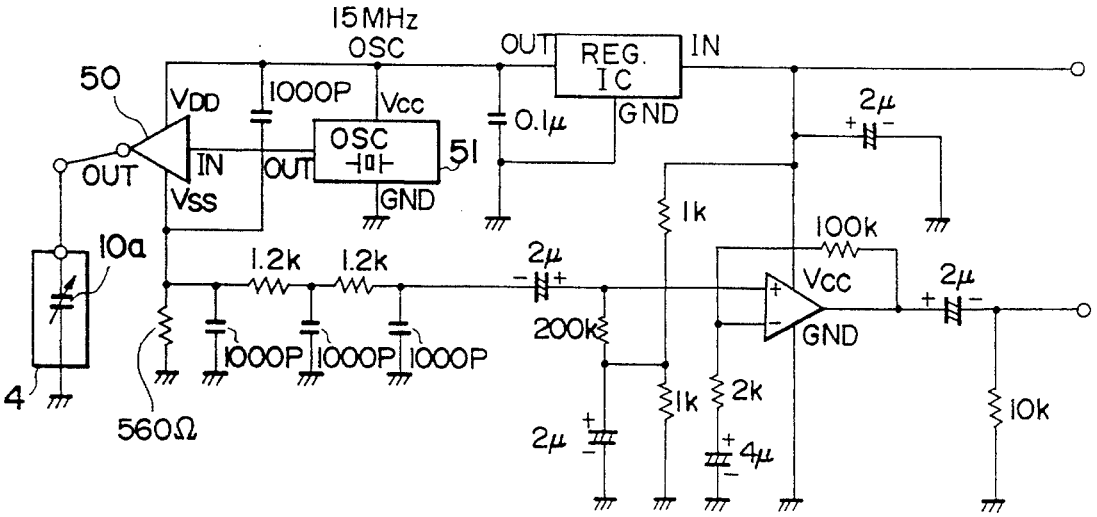
FIG. 7 is a diagram illustrating a sensor circuit of the printer.
Figure 8:
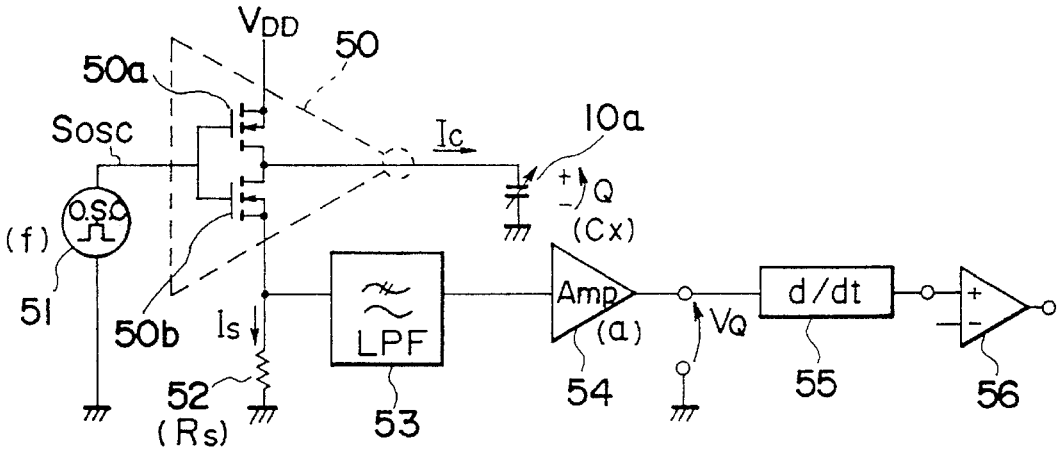
FIG. 8 is a diagram illustrating a block figure of the sensor circuit.
Figure 9:
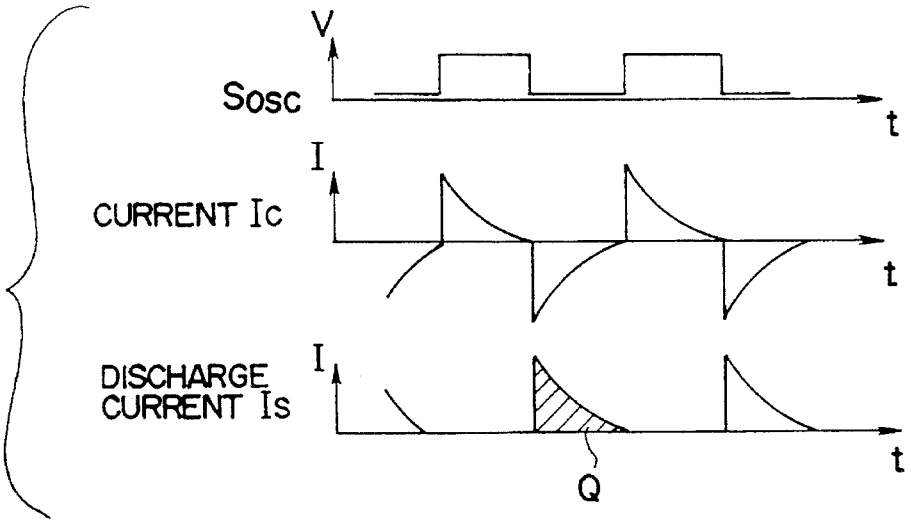
FIG. 9 is a diagram of wave forms of signals for the sensor circuit.

FIG. 7 is a diagram illustrating the sensor circuit 10*b*; FIG. 8 is a diagram for describing operation of the sensor circuit 10*b*; and FIG. 9 is a diagram of wave forms of signals for the sensor circuit 10*b*. In FIGS. 7 and 8, the sensor circuit 10*b* is constituted, as an internal equivalent circuit, of a digital IC 50 having MOSFETs (Field Effect Transistors) 50*a* and 50*b*, an oscillator 51, a resistor 52, an integrator (Low Pass Filter) 53, an amplifier 54, a differential circuit (d/dt) 55, and a comparator 56, and is connected to the sensor electrode 10*a* built in the wire dot head 4. In the sensor circuit 10*b* thus constructed, the output end of the digital IC 50 is connected to the sensor electrode 10*a*, and the input end of the digital IC 50 is connected to the oscillator 51. When the digital IC 50 receives an input square wave signal Sosc shown in FIG. 9 from the oscillator 51, a current Ic flows through the output end of the digital IC50. The MOSFETs 50*a* and 50*b* turn on and off alternatively by receiving the square wave signal Sosc, so that the current Ic becomes a charging and discharging current of the capacitance of the sensor electrode 10*a*. Discharge current Is flows to ground through the MOSFET 50*b* and the resistor 52. An integral value of the discharge current Is for one cycle (shaded area) is equivalent to the amount of electric charge Q charged into the sensor electrode 10*a*.

Where the static capacitance of the sensor electrode 10*a* is Cx; the oscillating frequency of the oscillator 51 is f; the resistive value of the resistor 52 is Rs; the amplifying rate of the amplifier 54 is a; and the power supply voltage is $V_{DD}$, the mean value of the discharging current Is is defined as $$f \cdot Q = f \cdot Cx \cdot V_{DD}$$

and output voltage Vo of the amplifier 54 is defined as $$Vo = Cx \cdot Rs \cdot a \cdot f \cdot V_{DD}$$

so that the output voltage $V_Q$ in proportion to the static capacitance Cx to be determined is obtained. The output voltage $V_Q$ is fed to the differential circuit 55, from which a voltage in proportion to the speed of the armature 32 shown in FIG. 4 is output. The output is fed to the comparator 56, so that the sensor circuit 10*b* outputs printing time T, at the end of which the printing wire 30 impacts the printing media P shown in FIG. 3. Practically, the amplifier 54 is used as an AC amplifier and makes the printing time T output based only on variations in the amount of sensor electrode capacitance with respect to the armature 32, while neglecting a voltage shift (DC components) due to, for example, distributed capacitance existing in addition to that of the sensor electrodes 10*a*.

Figure 10:
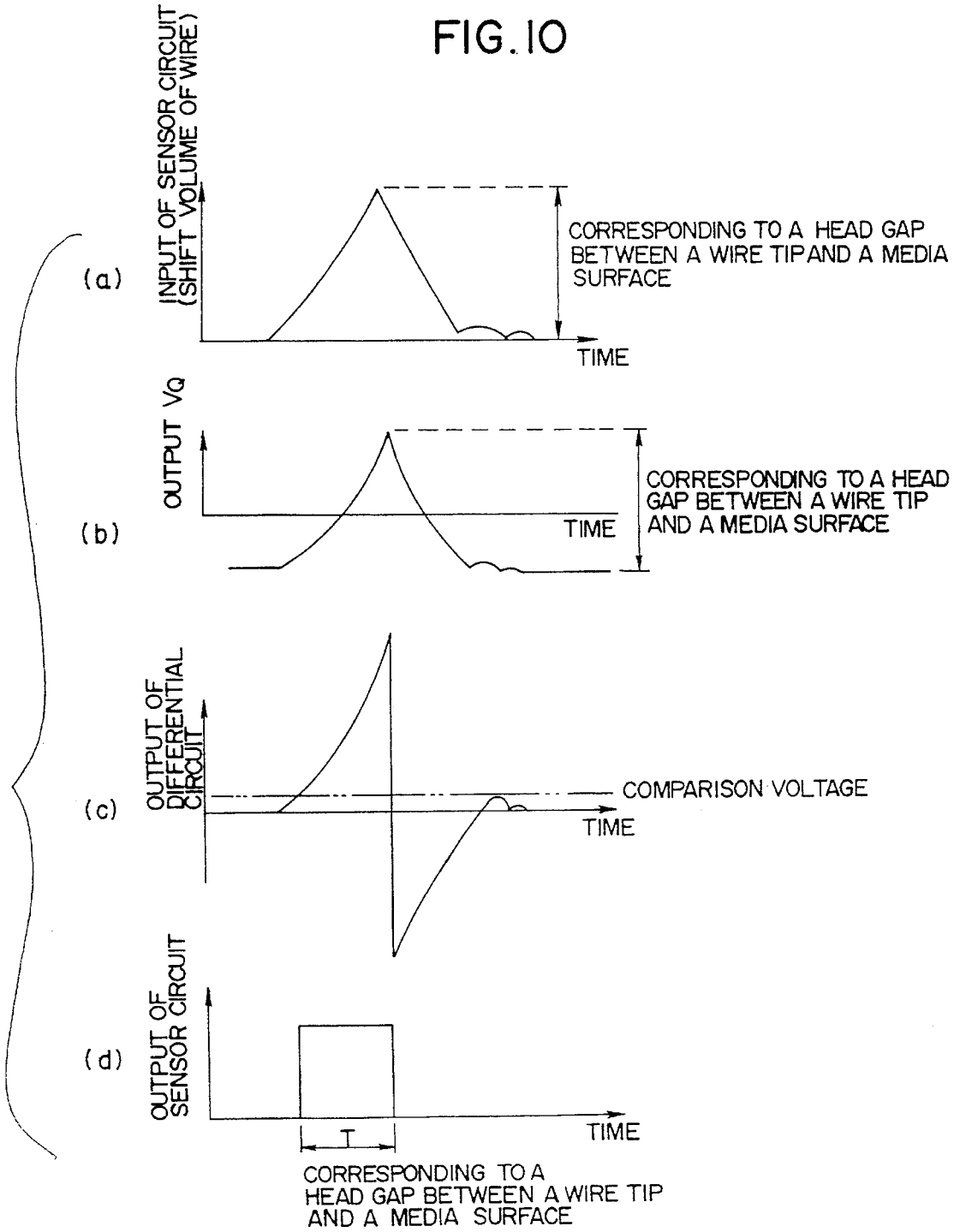
FIGS. 10(*a*), 10(*b*), 10(*c*) and 10(*d*) diagrams of wave forms of input and output signals of the sensor circuit.

FIG. 10 is a waveform diagram of the sensor circuit 10*b*. The output waveform of the sensor electrode 10*a* (shown in FIG. 8) is indicated as (a) in FIG. 10, and the output voltage $V_Q$ of the amplifier 54 in the sensor circuit 10*b* is indicated as (b) in FIG. 10. The output voltage $V_Q$ is then indicated as (c) in FIG. 10 after passing through the differential circuit 55, and finally, is detected as printing time T as shown in (d) in FIG. 10. Next, the CPU 2*c* (FIG. 1) inputs this printing time T through the interface LSI 2*b*. In the CPU 2*c*, a difference between the detected printing time T and a predetermined standard printing time Ts (for example, printing time when the wire dot head prints with a predetermined reference head gap gA of 0.5 mm through an ink ribbon (not shown) onto the printing media P of 0.08 mm) is determined, and then, a head gap g to the printing media P is calculated based on data according to a rule of thumb where a difference of 3 μsec in the printing time T corresponds to a head gap g of 0.01 mm. Then, a shift amount of the wire dot head 4 for setting the head gap g to a right value, or an optimum value, gR is calculated, and the wire dot head 4 is shifted only by the calculated shift amount by the gap shifting means 15 shown by FIGS. 3 and 4 to adjust the head gap g.

Next, the operations of a method of adjusting a head gap for a wire dot impact printer according to an embodiment of the invention will be described.

Figure 11:
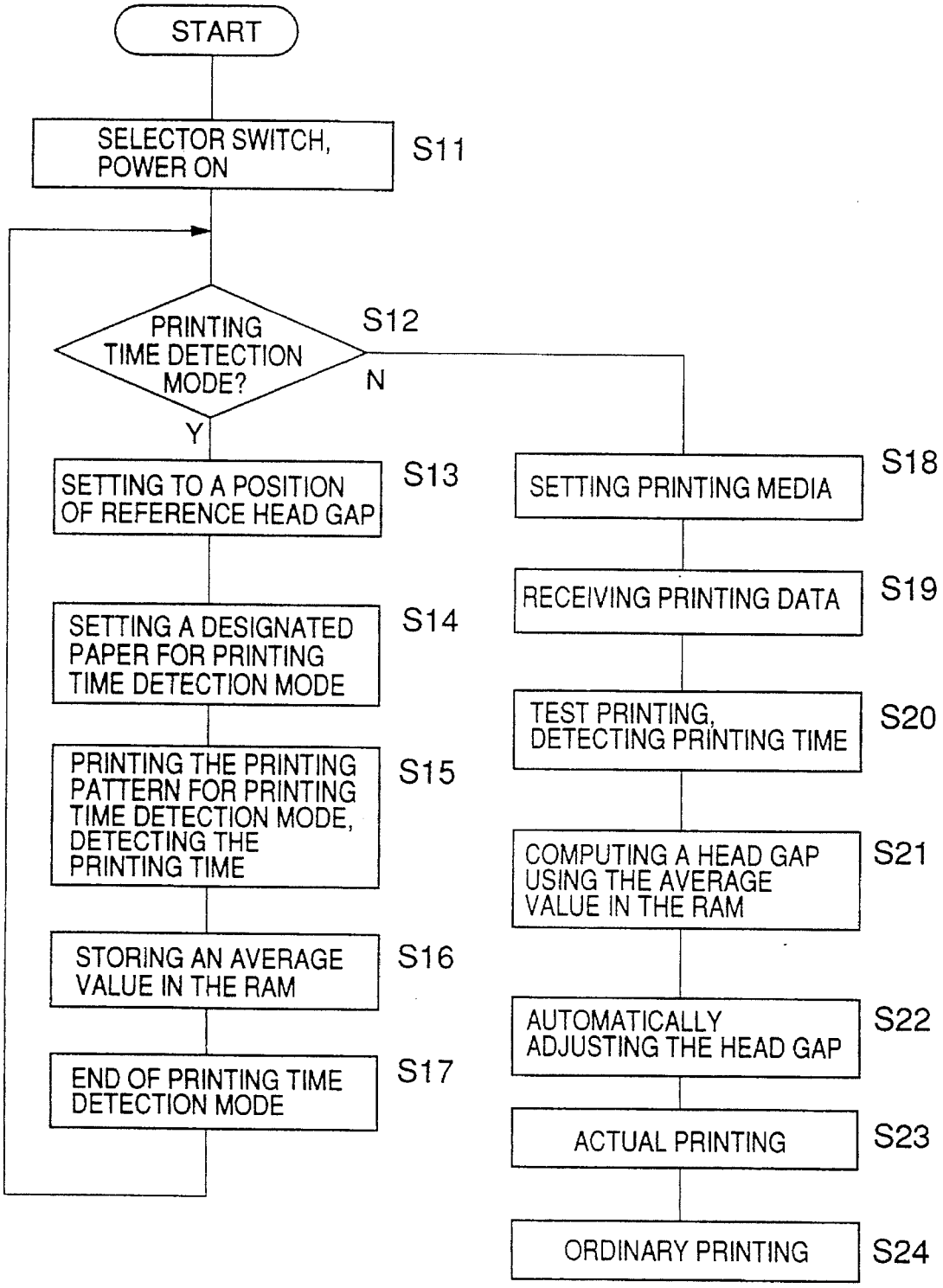
FIG. 11 is a flow chart showing a method of adjusting a head gap for a wire dot impact printer according to a first embodiment of the invention.
Figure 12:
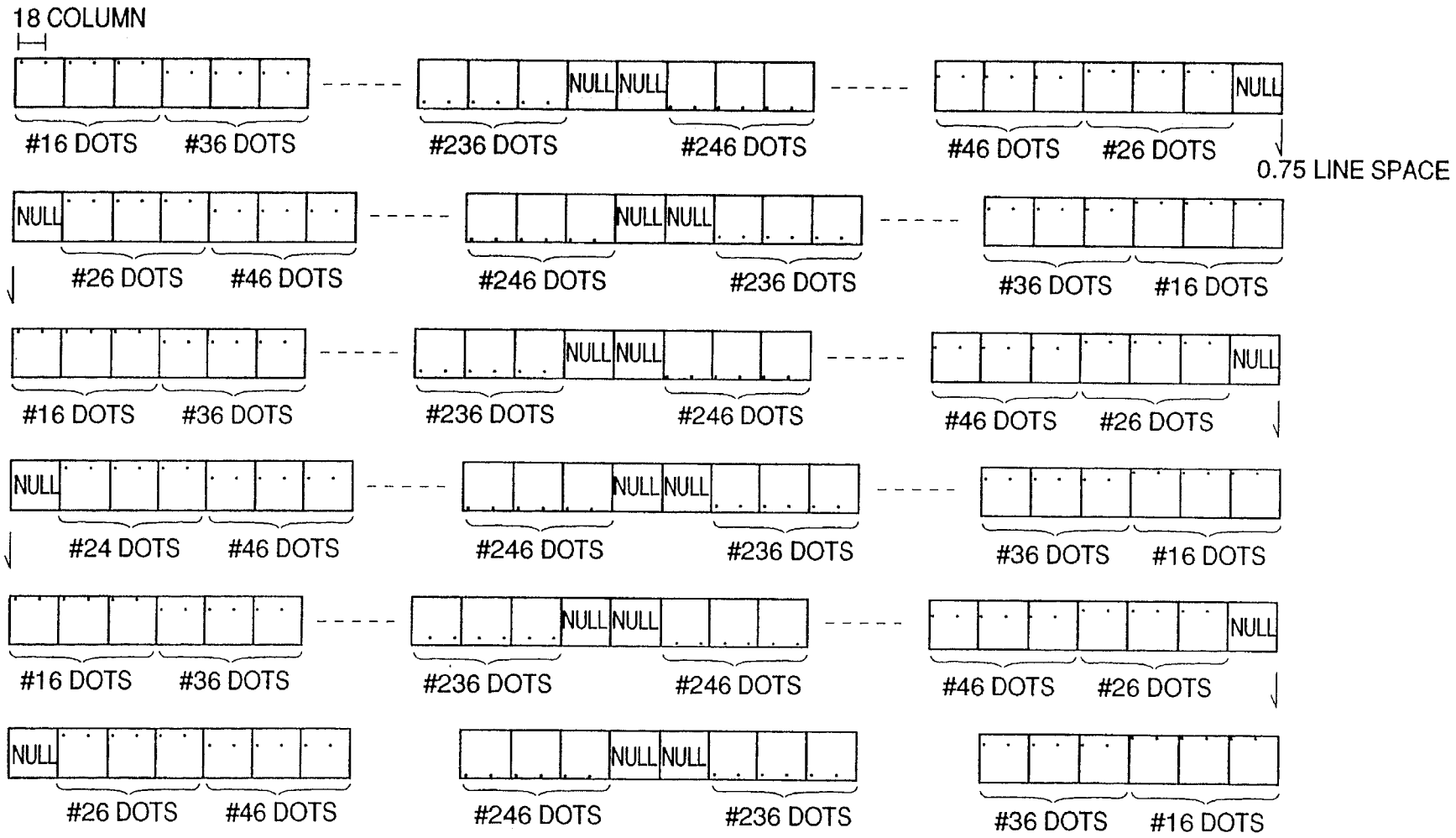
FIG. 12 is a diagram showing printing patterns for detecting printing times.

FIG. 11 is a flow chart showing a method of adjusting a head gap for wire dot impact printer according to a first embodiment of the invention; and FIG. 12 is a diagram showing a printing pattern for detecting printing time.

At step S11, the selector switch 11 shown in FIG. 1 is pushed down. In this embodiment, a printing time detection mode can be selected by pushing down the selector switch 11 before the power of the wire dot impact printer is turned on. A judgment is made at step S12 as to whether or not the printing time detection mode is selected. If the mode is selected, the program goes to S13. If the mode is not selected, the program goes to S18. At step S13, the wire dot head 4 is set to a position at which a reference head gap gA is obtained. Designated paper, for example, 55 kg simple paper, for the printing time detection mode is set between the wire dot head 4 and the platen 25 shown in FIG. 2 at step S14. At step S15, a printing pattern as shown in FIG. 12 is printed, and then, a standard printing time $T_P$ of each of pins #1 to #24 is detected.

Although the printing pattern is not restricted as far as which of the printing wires 30 (as shown in FIG. 4) of the wire dot head 4 can be used repeatedly and stably, a printing pattern in which a plurality of the printing wires 30 are not driven at the same time is set in this embodiment. In this case, dispersions of the detected printing time $T_P$ are reduced by printing in two directions. The printing time $T_P$ is detected using changes of the static capacitance Cx between the sensor electrode 10a and the armature 32 in the wire dot head 4 shown in FIG. 4.

At step S16, an average value $T_{PA}$ of the printing times $T_P$ of respective pins #1 to #24 is calculated and stored in the RAM 2*d*. The RAM 2*d* is supported by a back up battery and has functions of data rewriting and memory retention. It is possible to provide an EEPROM separately, in which the average value $T_{PA}$ of the printing time $T_P$ is stored. Next, at step S17, the printing time detection mode ends, and then the program flow goes back to step S12. The printing media P of various kinds to be actually printed are set between the wire dot head 4 and the platen 25 at step S18. At step S19, printing data from a host computer (not shown) are received. Then, the position of the wire dot head 4 is adjusted to a position of the reference head gap gA for test printing. Test printing dots of several dots to several tens of dots are selected, and then test printing is done to detect the printing time T of the test printing at step S20. The difference between the average value $T_{PA}$ written in the RAM 2*d* during the previously described printing time detection mode, and the detected printing time T in this operation, is calculated. According to a relationship where a difference of printing time of 3 μsec corresponds to a head gap g of 0.01 mm, the head gap g to the printing media P, corresponding to the inherent characteristic of the mounted wire dot head 4, is calculated at step S21. The thickness of the printing media P being set is judged. Next, a shift amount of the wire dot head 4 is calculated for setting the head gap g to an optimum value gR according to the thickness of the printing media P, and then the head gap is automatically adjusted by driving the gap shifting means 15 at step S22. At step S23, an actual printing is done for the line at which the test printing is done. Then, ordinary printing starts at step S24.

Next, a second embodiment of the invention will be described.

Figure 13:
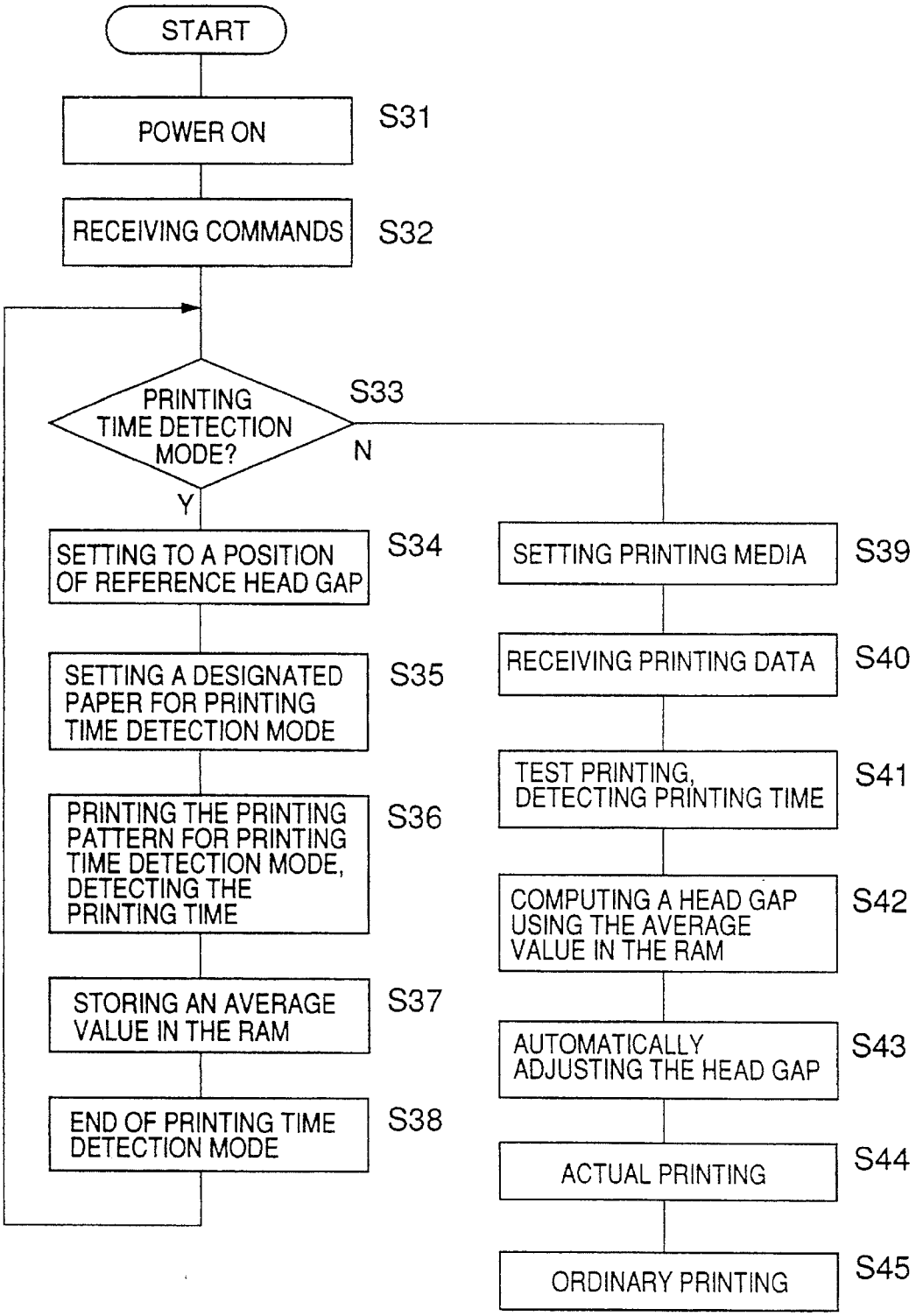
FIG. 13 is a flow chart showing a method of adjusting a head gap for a wire dot impact printer according to a second embodiment of the invention.

FIG. 13 is a flow chart showing a method of adjusting a head gap for a wire dot impact printer according to the second embodiment of the invention.

At step S31, the power of the wire dot impact printer is turned on. The printer receives commands from a host computer (not shown) at step S32. A judgment is made at step S33 as to whether or not the printing time detection mode is selected. If the mode is selected, the program goes to S34. If the mode is not selected, the program goes to S39. At step S34, the wire dot head 4 shown in FIG. 1 is set to a position at which a reference head gap gA is obtained. Designated paper for printing time detection mode is set at step S35. At step S36, a printing pattern as shown in FIG. 12 is printed, and then, standard printing time $T_P$ of each of pins #1 to #24 is detected. At step S37, an average value $T_{PA}$ of the printing times $T_P$ of respective pins #1 to #24 is calculated and stored in the RAM 2*d*. At step S38, the printing time detection mode ends, and then the program flow goes back to step S33. The printing media P of various kinds to be actually printed are set between the wire dot head 4 and the platen 25 shown in FIG. 3 at step S39. At step S40, printing data from a host computer are received. Then, the position of the wire dot head 4 is adjusted to a position of the reference head gap gA for test printing. Test printing dots of several dots to several tens of dots are selected, and then test printing is done to detect the printing time T of the test printing at step S41. The difference between the average value $T_{PA}$ written in the RAM 2*d* during the printing time detection mode and the detected printing time T in this operation is calculated, and the head gap g to the printing media P corresponding to the inherent characteristic of the mounted wire dot head 4 is calculated at step S42. The thickness of the printing media P being set is judged. Next, a shift amount of the wire dot head 4 is calculated for setting the head gap g to an optimum value gR according to the thickness of the printing media P, and then, the head gap is automatically adjusted by driving the gap shifting means 15 at step S43. At step S44, an actual printing is done for the line at which the test printing has been done. Then, ordinary printing starts at step S45.

In the first and second embodiments, after the position of the wire dot head 4 is adjusted so that the head gap g is set to the reference head gap gA for test printing, the test printing of several dots to several tens of dots is performed. In this case, if the reference head gap gA is set to be narrow, the accuracy of detection of the printing time T becomes high when the printing media P is thin, but the surface of the printing media P is worn down to appear ugly when the printing media P is thick. On the contrary, if the reference head gap gA is set to be broad, the surface of the printing media P is not worn down to appear ugly even when the printing media P is thick, but the accuracy of detection of the printing time T becomes low when the printing media P is thin. When the detected printing time T during the test printing is zero, the head gap g may be improperly determined. Moreover, if the dot number of the test printing is extremely small, the detection accuracy of the printing time T is likely to be low.

Now, described will be a third embodiment of the invention in which: the printing time T is detected with high accuracy; wearing down the surface of the printing media P is avoided, avoiding an ugly appearance, when the test printing is done; the head gap g is determined properly even when the printing time $T_P$ detected through printing during the printing time detection mode, or the printing time T detected during the test printing, is zero; and the head gap g is not judged when the dot number of the test printing is quite small.

Figure 14:
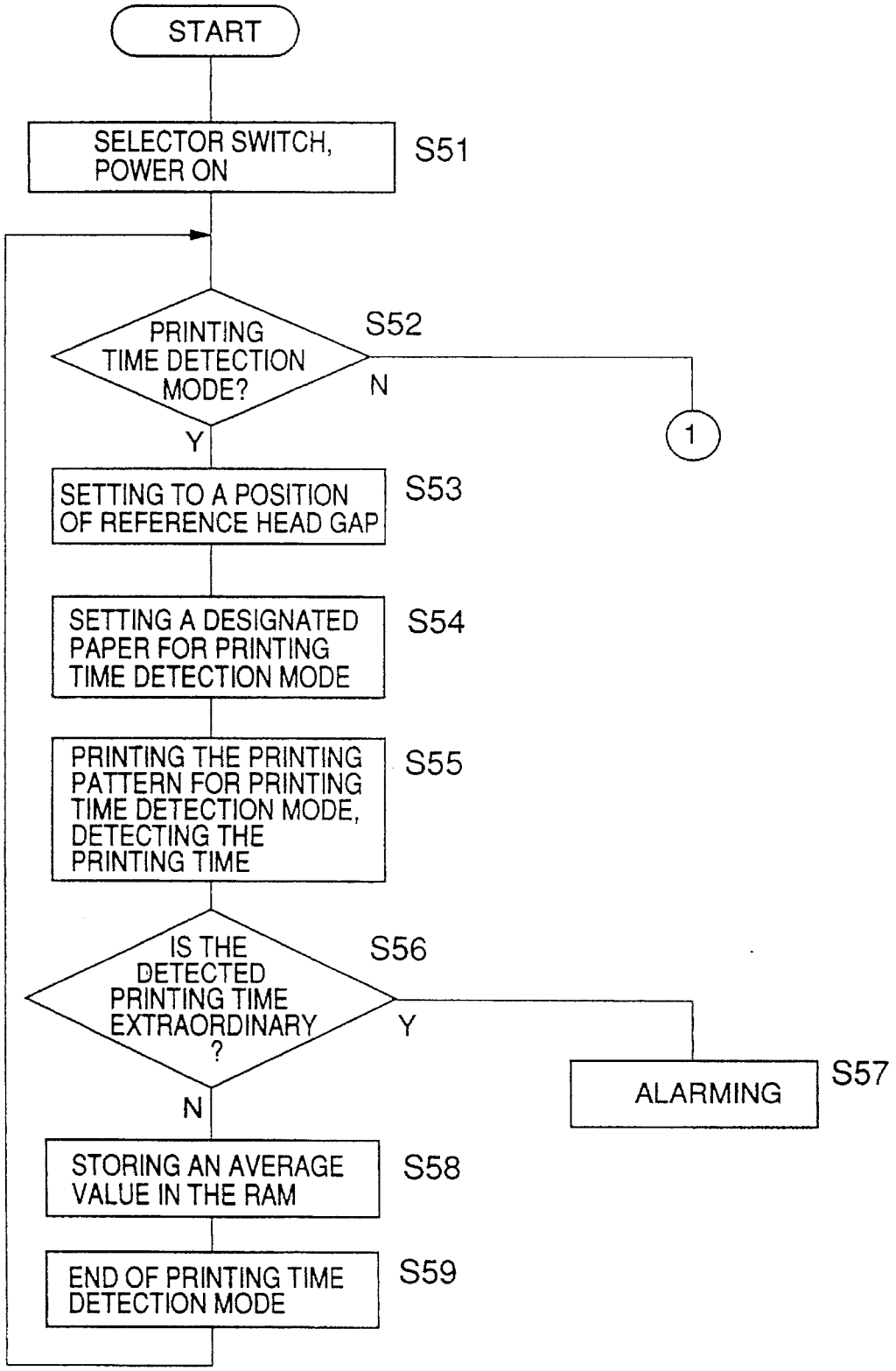
FIGS. 14, 15 and 16 are flow charts showing a method of adjusting a head gap for a wire dot impact printer according to a third embodiment of the invention.
Figure 15:
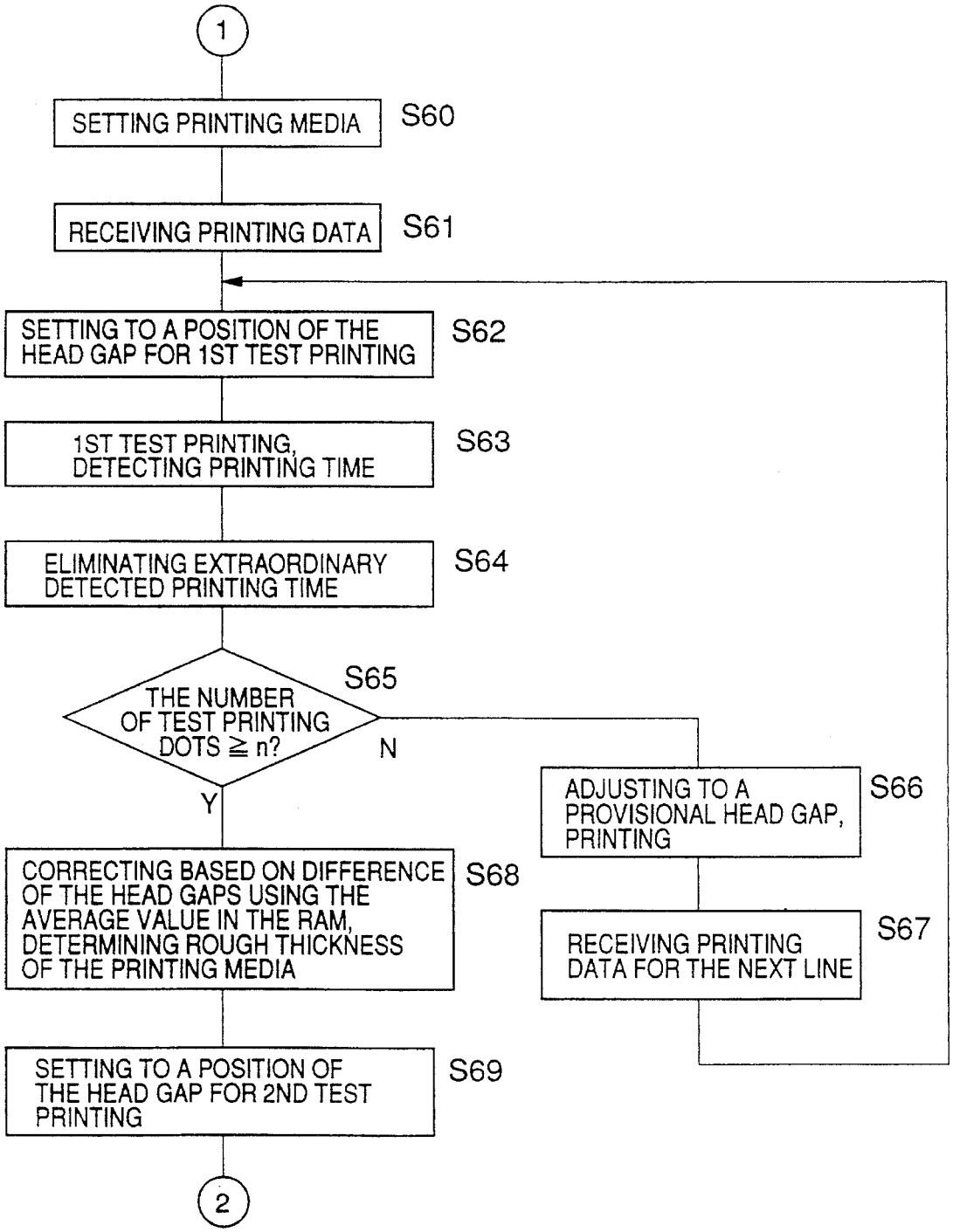
Figure 16:
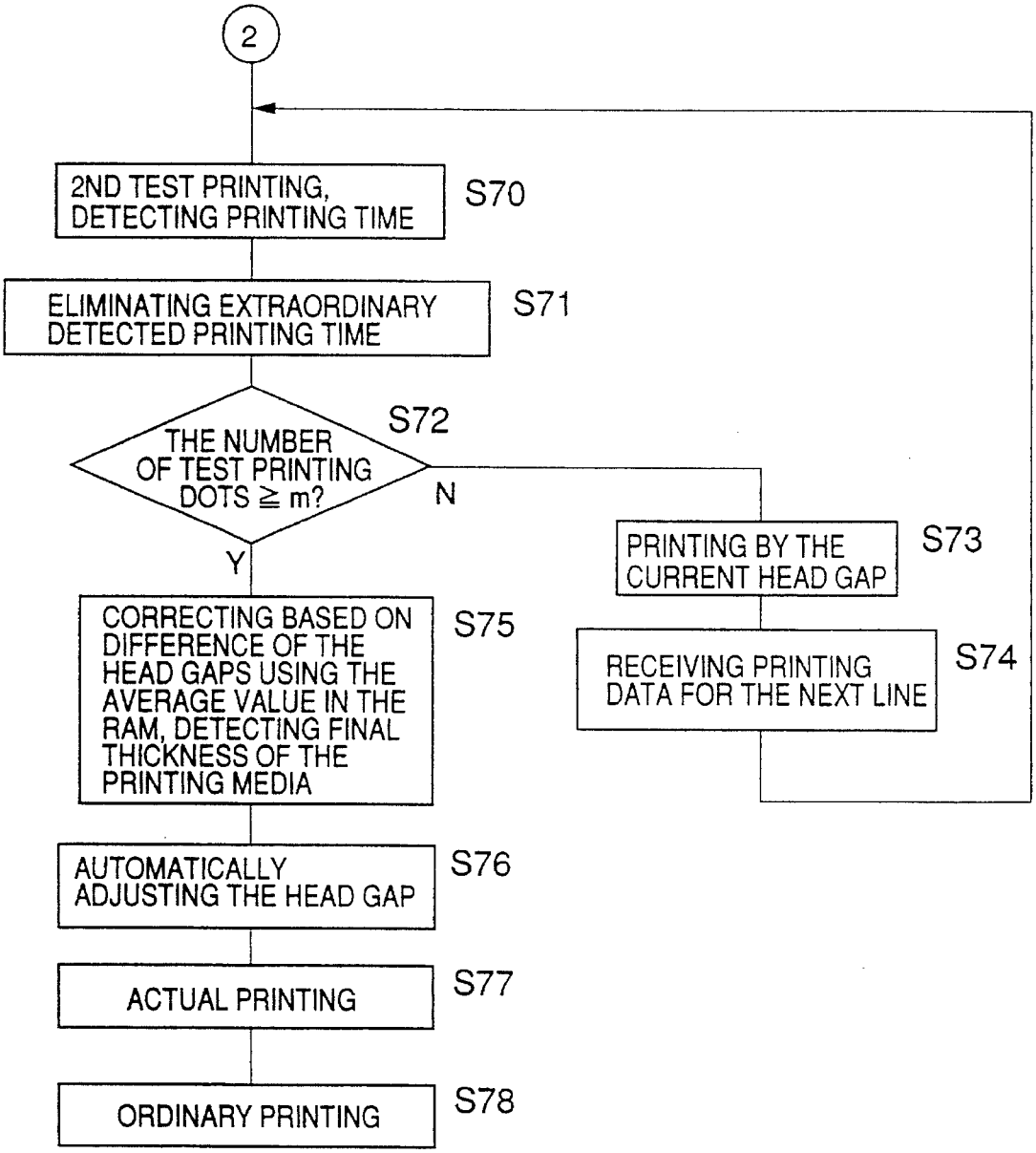

FIG. 14 is a first flow chart showing a method of adjusting a head gap for a wire dot impact printer according to the third embodiment of the invention; FIG. 15 is a second flow chart showing a method of adjusting a head gap for a wire dot impact printer according to the third embodiment of the invention; and FIG. 16 is a third flow chart showing a method of adjusting a head gap for a wire dot impact printer according to the third embodiment of the invention.

At step S51, the selector switch 11 (shown in FIG. 1) is pushed down. In this embodiment, printing time detection mode can be selected by pushing down the selector switch 11 before the power of the wire dot impact printer is turned on. A judgment is made at step S52 as to whether or not the printing time detection mode is selected. If the mode is selected, the program goes to S53. If the mode is not selected, the program goes to S60. At step S53, the wire dot head 4 is set to a position at which a reference head gap gA is obtained. Designated paper for printing time detection mode is set between the wire dot head 4 and the platen 25 (shown in FIG. 3) at step S54. At step S55, a printing pattern as shown in FIG. 12 is printed, and then, standard printing time $T_P$ of each of pins #1 to #24 is detected. A judgment is made at step S56 as to whether or not there is any extraordinary printing time, such as zero or an extremely long time, among the detected printing times of respective pins #1 to #24. If there is some extraordinary printing time, the program goes to S57. If there is not any extraordinary printing time, the program goes to S58. At step S57, an alarm sign is displayed, such as with LEDs or a buzzer is sounded, and the process ends. At step S58, an average value $T_{PA}$ of the printing times $T_P$ of respective pins #1 to #24 is calculated and stored in the RAM **2*d*. The RAM 2*d* is supported by a back up battery and has the functions of data rewrite and memory retention. It is also possible to provide an EEPROM separately, in which the average value $T_{PA}$ is stored. At step S59, the printing time detection mode ends, and then the program flow goes back to step S52. The printing media P of various kinds to be actually printed are set between the wire dot head 4 and the platen 25 at step S60 (FIG. 15). At step S61, printing data from a host computer (not shown) is received. Then, in order to judge whether the printing media P is thick or thin during the first test printing, the wire dot head 4 is adjusted to the reference head gap gB for a first test printing so as to become adequately broad at S62. Test printing dots of several dots to several tens of dots are selected, and then first test printing is done to detect the printing time T of the first test printing at step S63. Extraordinary printing times, such as printing times equivalent to zero or extremely long times, are eliminated from the detected printing times T at step S64. A judgment is made at step S65 as to whether or not the dot number of the first test printing is equal to or greater than n, which is a number which is at least required for a judgment of thickness of the printing media P. If it is equal to or greater than n, the program goes to step S68. If it is less than n, the program goes to step S66. At step 66, since minimum data required for judging thickness of the printing media P are not obtained, the head gap is adjusted to a provisional head gap, predetermined for the time of shortage of data, and the line is printed. Then, at step S67, printing data for the next line sent from the host computer are received and the program flow returns to step S62. On the other hand, if the dot number is $\geqq$n, the difference between the average value $T_{PA}$ written in the RAM 2*d* during the printing time detection mode and the detected printing time T in this operation is calculated at step S68. A correction is made based the difference between the reference head gap gA for printing time detection mode and the head gap gB for the first test printing. According to the relationship where a difference in the printing time T of 3 μsec corresponds to a head gap g of 0.01 mm, the head gap g between the printing media P and the mounted wire dot head 4 is calculated, and the rough thickness of the printing media P being set is judged. In order to judge the thickness of the printing media P more accurately, the wire dot head 4 is set to a position of a head gap gC for a second test printing narrower than the head gap gB for the first test printing, in accordance with the rough thickness of the printing media P being set, at step S69. At step S70 (FIG. 16), the test printing dots for several dots to several tens of dots are selected, and the second test printing is done to detect the printing time of the second test printing. Extraordinary printing times, such as printing times equivalent to zero or extremely long times, are eliminated from the detected printing times T at step S71. A judgment is made at step S72 as to whether or not the dot number of the second test printing is equal to or greater than m, which is a number which is at least required for a judgment of final thickness of the printing media P. If it is equal to or greater than m, the program goes to step S75. If it is less than m, the program goes to step S73. At step 73, since minimum data required for judging thickness of the printing media P are not obtained, the line is printed with the current head gap gC. Then, at step S74, printing data for the next line sent from the host computer are received and the program flow returns to step S70. On the other hand, if the dot number ≧m, the difference between the average value $T_{PA}$ written in the RAM 2***d* during the printing time detection mode and the detected printing time T in this operation is calculated at step S75, and a correction is made based the difference between the reference head gap gA for printing time detection mode and the head gap gC for the second test printing. According to the relationship where a difference of a printing time T of 3 μsec corresponds to a head gap g of 0.01 mm, the head gap g between the printing media P and the mounted wire dot head 4 is calculated, and the final thickness of the printing media P being set is judged. Next, a shift amount of the wire dot head 4 is calculated for setting the head gap g to an optimum value gR according to the final thickness of the printing media P, and then, the head gap is automatically adjusted by driving the gap shifting means 15, at step S76. At step S77, an actual printing is done for the line at which the test printing is done. Then, ordinary printing starts at step S78.

As described above, in this embodiment, the printing time T is detected with high accuracy since a board head gap gB for the first test printing is set when the first test printing is done, and since a narrow head gap gC for the second test printing is set when the second test printing is done. When the first test printing is done, the appearance of surface of the printing media P does not become ugly because the head gap gB for the first test printing to be set is broad. When the second test printing is done, the appearance of surface of the printing media P does not become ugly because the head gap gC for the second test printing is set based on the rough thickness of the printing media P, even though the head gap gC for the second test printing to be set is narrow. Since extraordinary printing time, such as zero or an extremely long printing time, is eliminated from detected printing times T, the head gap g is always determined properly. Moreover, since the head gap g is not judged when the dot number of the first test printing is less than n, or when the dot number of the second test printing is less than m, the printing time is always detected with high accuracy.

Next, a fourth embodiment of the invention will be described.

Figure 17:
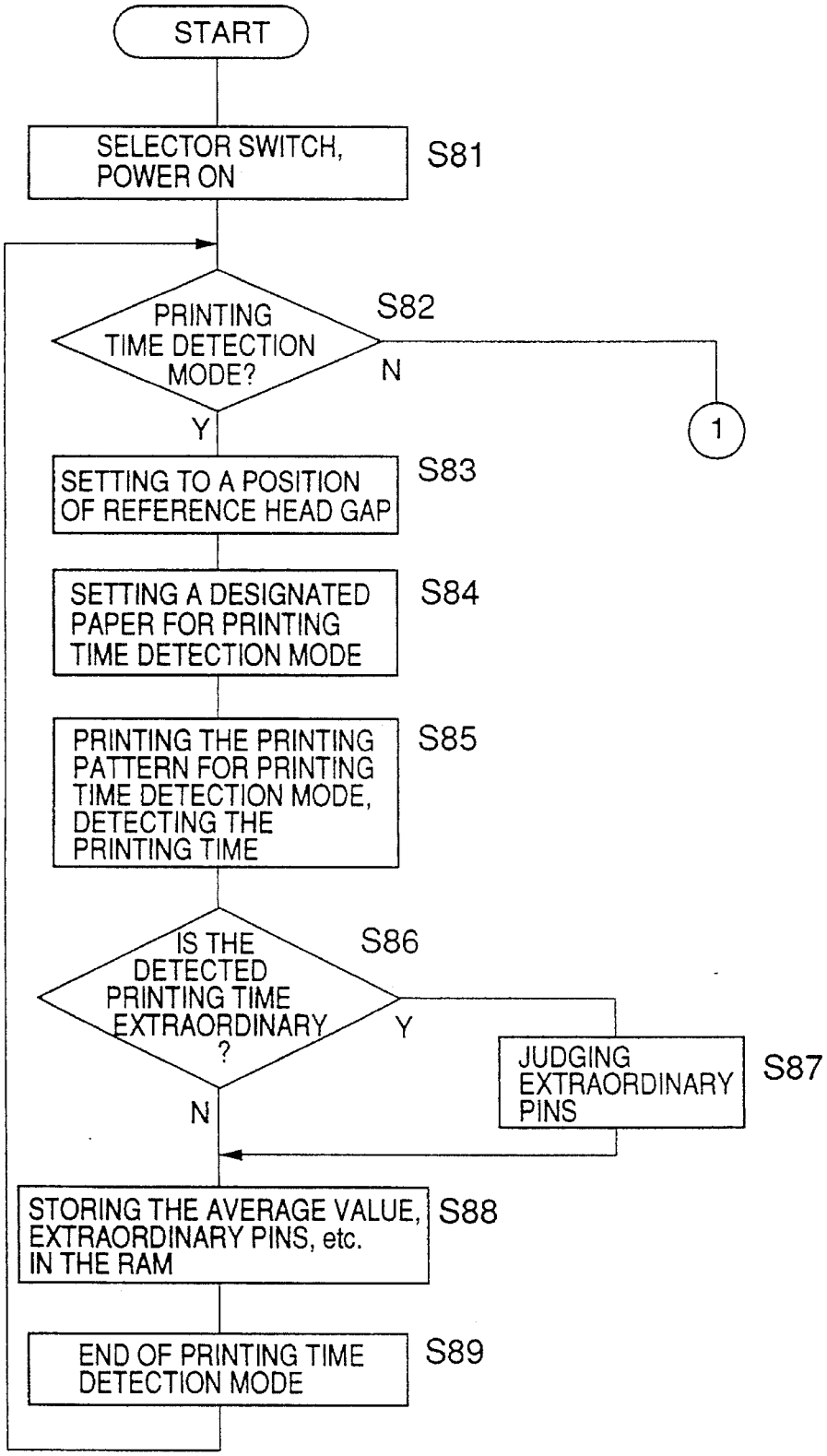
FIGS. 17, 18 and 19 are flow charts showing a method of adjusting a head gap for a wire dot impact printer according to a fourth embodiment of the invention.
Figure 18:
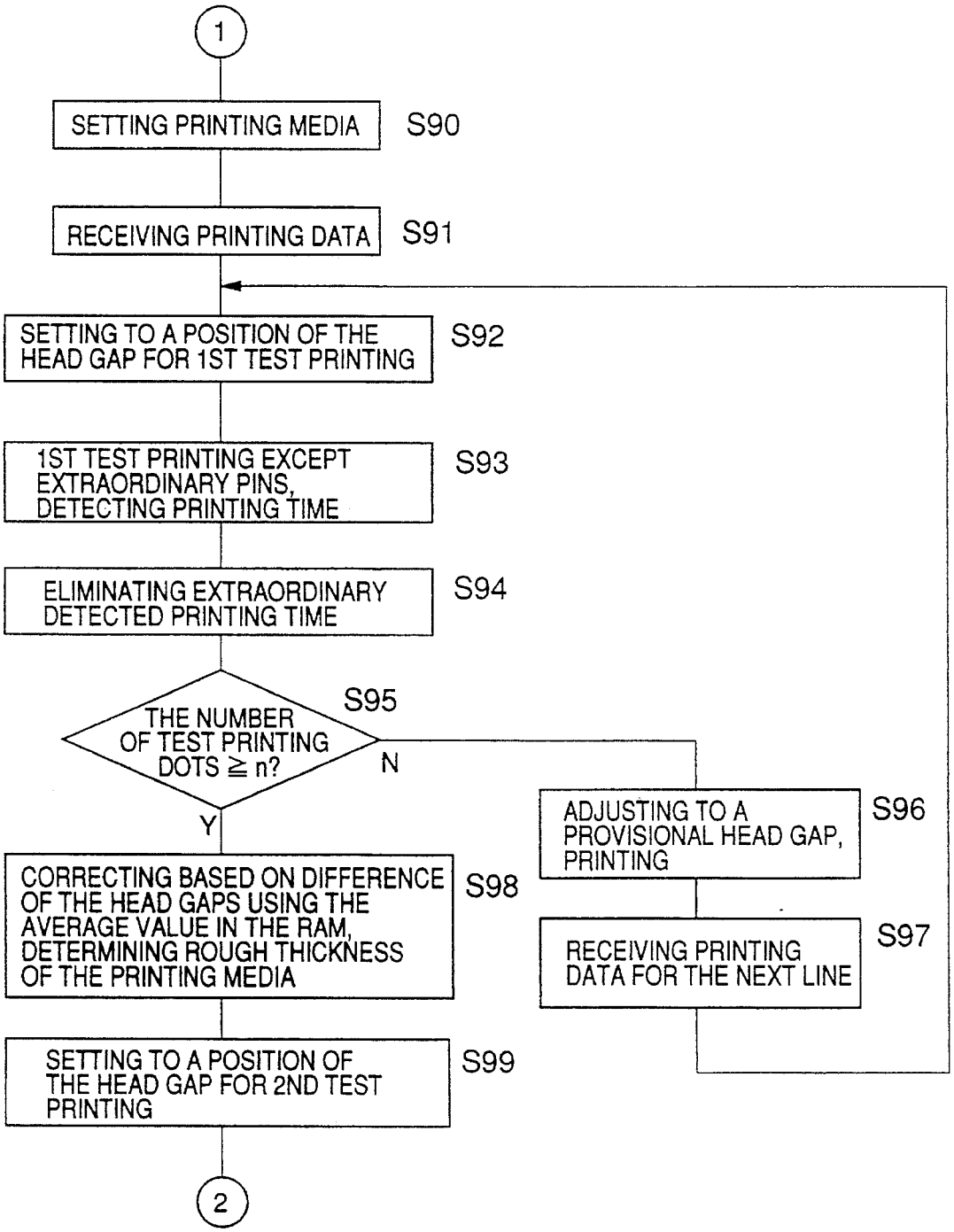
Figure 19:
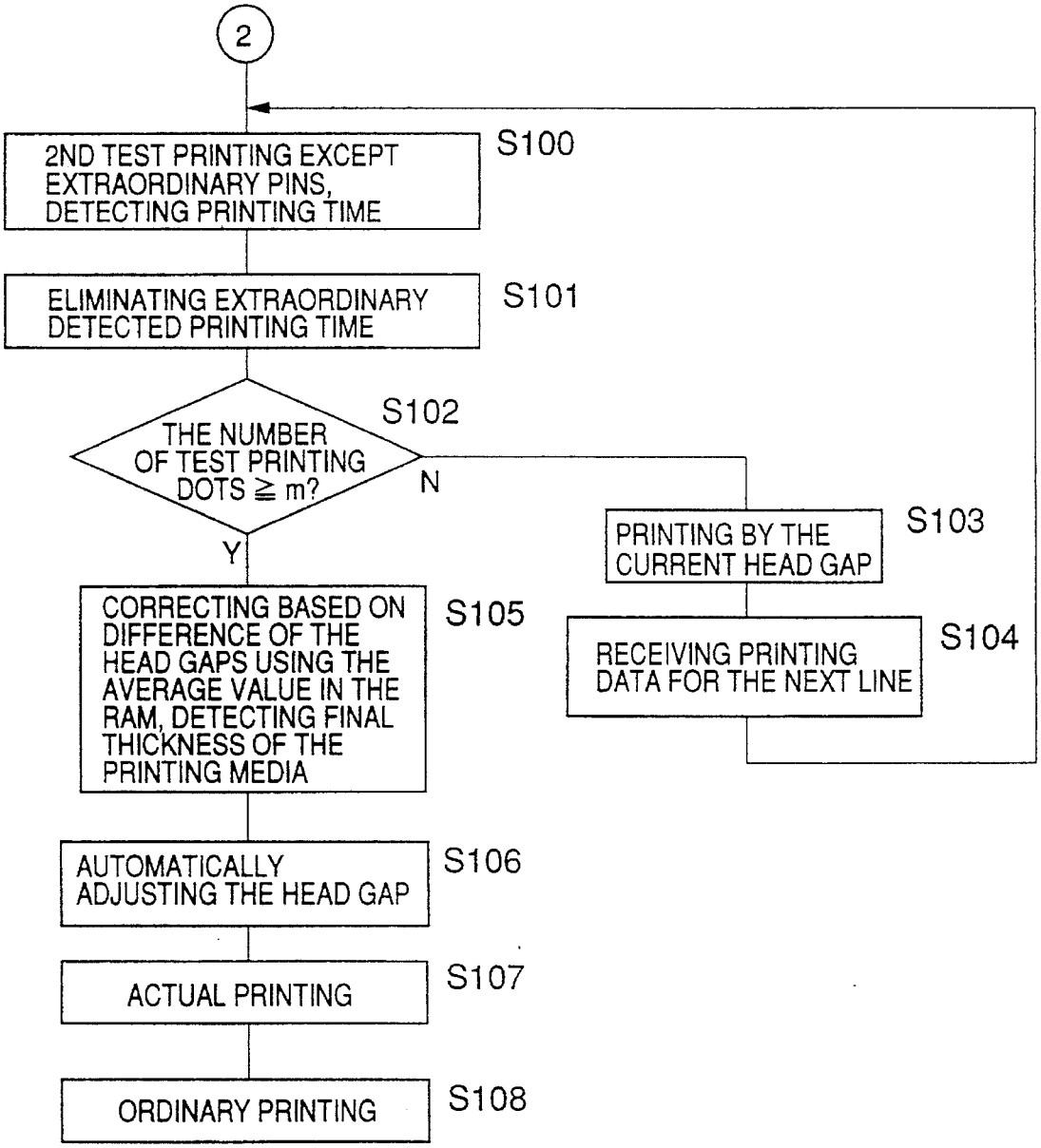

FIG. 17 is a first flow chart showing a method of adjusting a head gap for a wire dot impact printer according to the fourth embodiment of the invention; FIG. 18 is a second flow chart showing a method of adjusting a head gap for a wire dot impact printer according to the fourth embodiment of the invention; and FIG. 19 is a third flow chart showing a method of adjusting a head gap for a wire dot impact printer according to the fourth embodiment of the invention.

Since steps S81 to S85 are the same to steps S51 to S55 of the third embodiment, the description for those steps is omitted. At step S86, a judgment is made as to whether or not there is any extraordinary printing time, such as printing time of zero or an extremely long printing time (for instance 1 msec or above), among the detected printing times Tp of respective pins #1 to #24. If there is extraordinary one, the program goes to the step S87. If there is no extraordinary one, the program goes to the step S88. At step S87, it is judged which pins of extraordinary printing time (hereinafter, called "extraordinary pins") are among the detected printing times Tp of respective pins #1 to #24. An average value $T_{PA}$ of the printing times $T_P$ of respective pins #1 to #24 except the extraordinary pins is calculated and stored in the RAM 2*d* at step S88. At the same time, the identity of the extraordinary pins is also stored. Then, at step S89, the printing time detection mode ends and the program flow goes back to the step S82. The steps S90 to S92 (FIG. 18) are the same to the steps S60 to S62 of the third embodiment, so the description for those steps is omitted. At step S93, using the information about the extraordinary pins written in the RAM 2*d*, test printing dots of several dots to several tens of dots are selected. Then, the first test printing is done with pins except extraordinary pins, and printing time T of the first test printing is detected. The steps S94 to S99 are the same to the steps S64 to S69 of the third embodiment, so the description is omitted. At step 100 (FIG. 19), using the information of the extraordinary pins written in the RAM 2*d*, test printing dots of several dots to several tens of dots are selected. Then, the second test printing is done with pins except extraordinary pins, and printing time T of the second test printing is detected. The steps S101 to S108 are the same to the steps S71 to S78 of the third embodiment, so the description is omitted.

Next, a fifth embodiment of the invention will be described.

Figure 20:
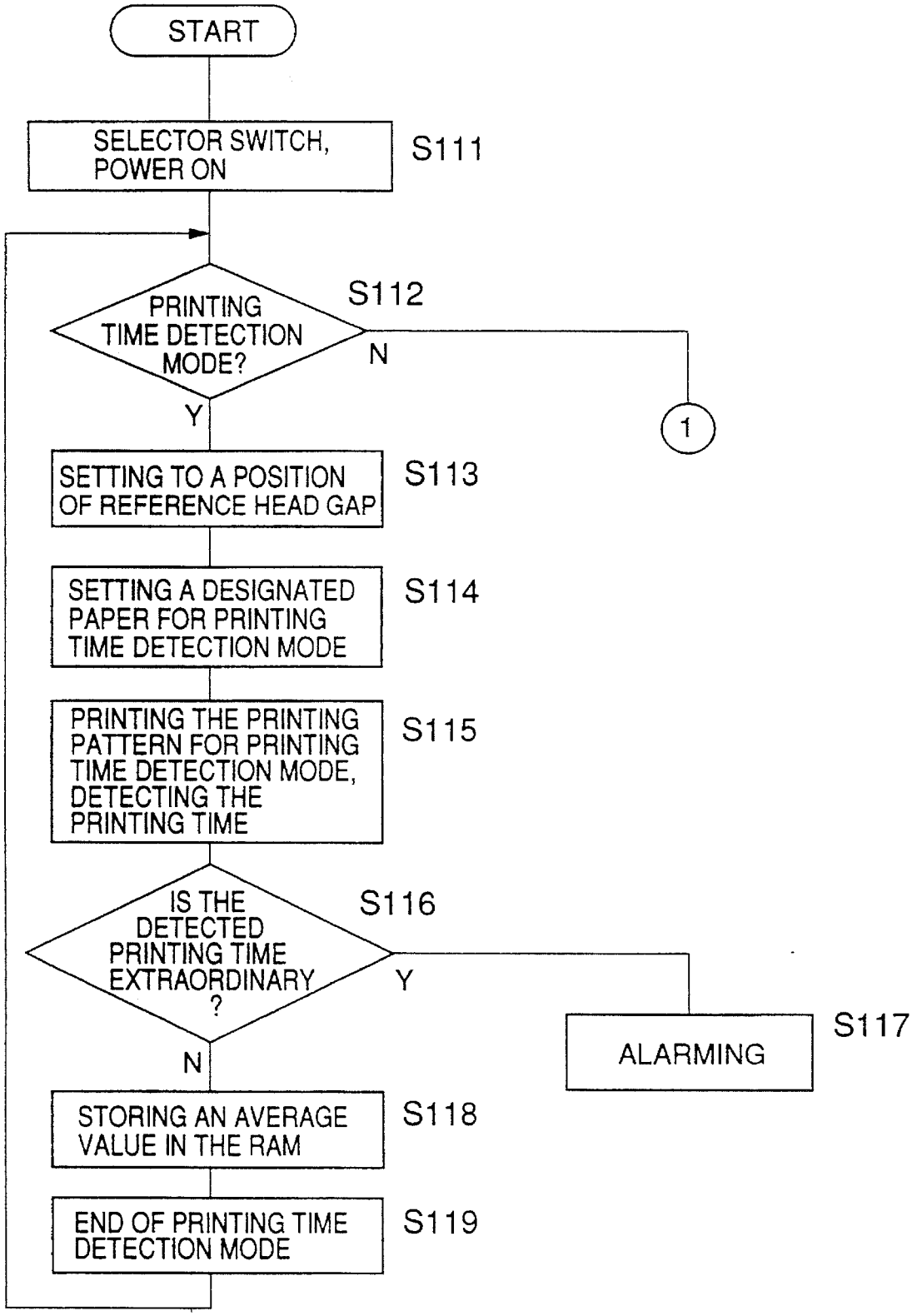
FIGS. 20 and 21 are flow charts showing a method of adjusting a head gap for a wire dot impact printer according to a fifth embodiment of the invention.
Figure 21:
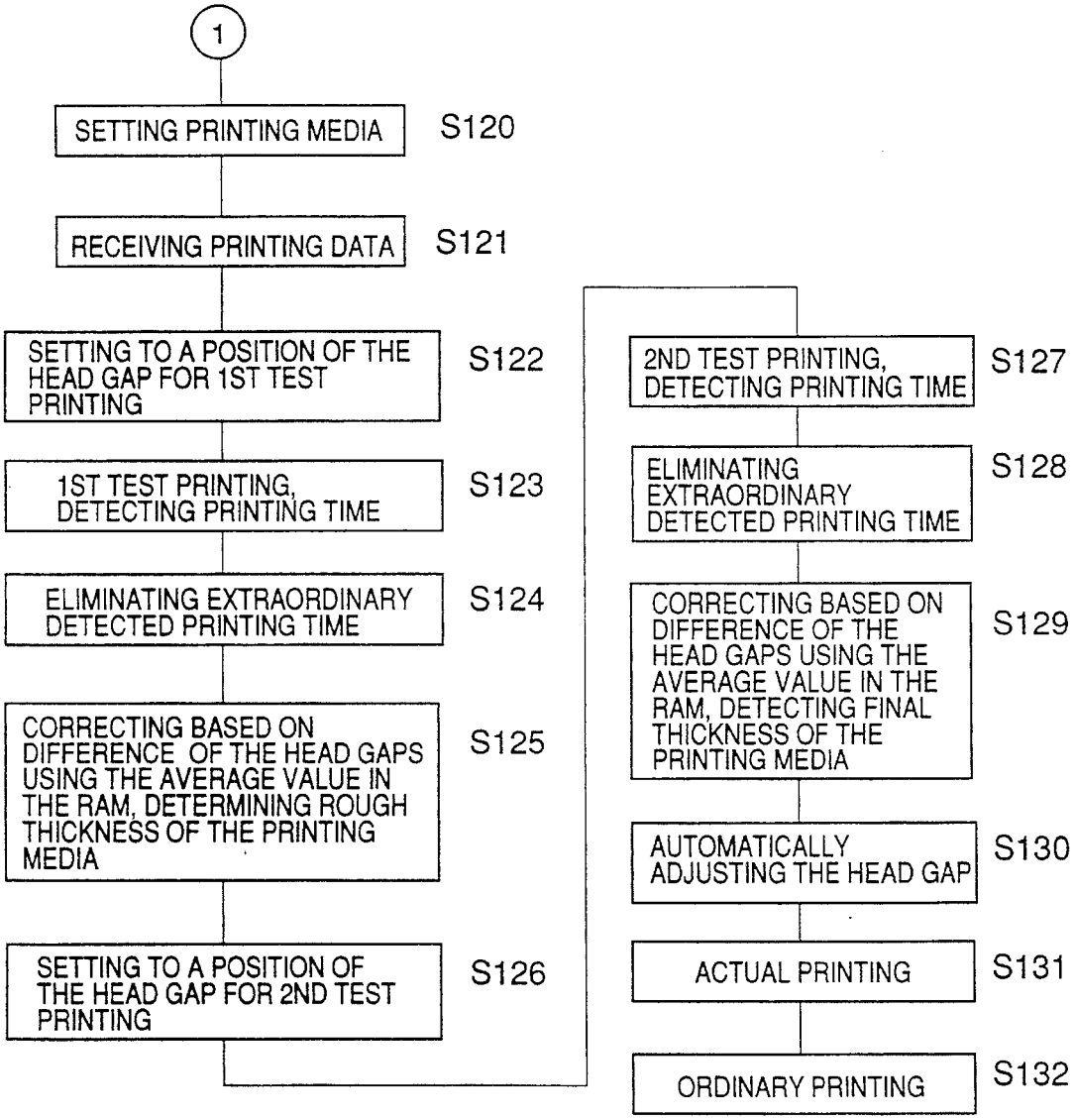

FIG. 20 is a first flow chart showing a method of adjusting a head gap for a wire dot impact printer according to the fifth embodiment of the invention; and FIG. 21 is a second flow chart showing a method of adjusting a head gap for a wire dot impact printer according to the fifth embodiment of the invention. In this embodiment, during the first test printing, the thickness of the printing media P is judged without the judgment (e.g. step S65) as to whether or not the dot number of the test printing is equal to or greater than n, which is at least required for a judgment of the thickness of the printing media P, and a head gap gC for the second test printing is set. During the second test printing, the final thickness of the printing media P is judged without the judgment (e.g., step S72) as to whether or not the dot number of the test printing is equal to or greater than m, which is at least required for a judgment of the thickness of the printing media P. Then, a shift amount of the wire dot head 4 is calculated for setting the head gap g to the optimum value gR in accordance with the thickness of the printing media P, and the head gap is automatically adjusted by driving the gap shifting means 15. The steps S111 to S132 are the same to the steps S51 to S64, steps S68 to S71, and steps S75 to S78 of the third embodiment, so the description for those steps is omitted.

Next, a sixth embodiment of the invention will be described.

Figure 22:
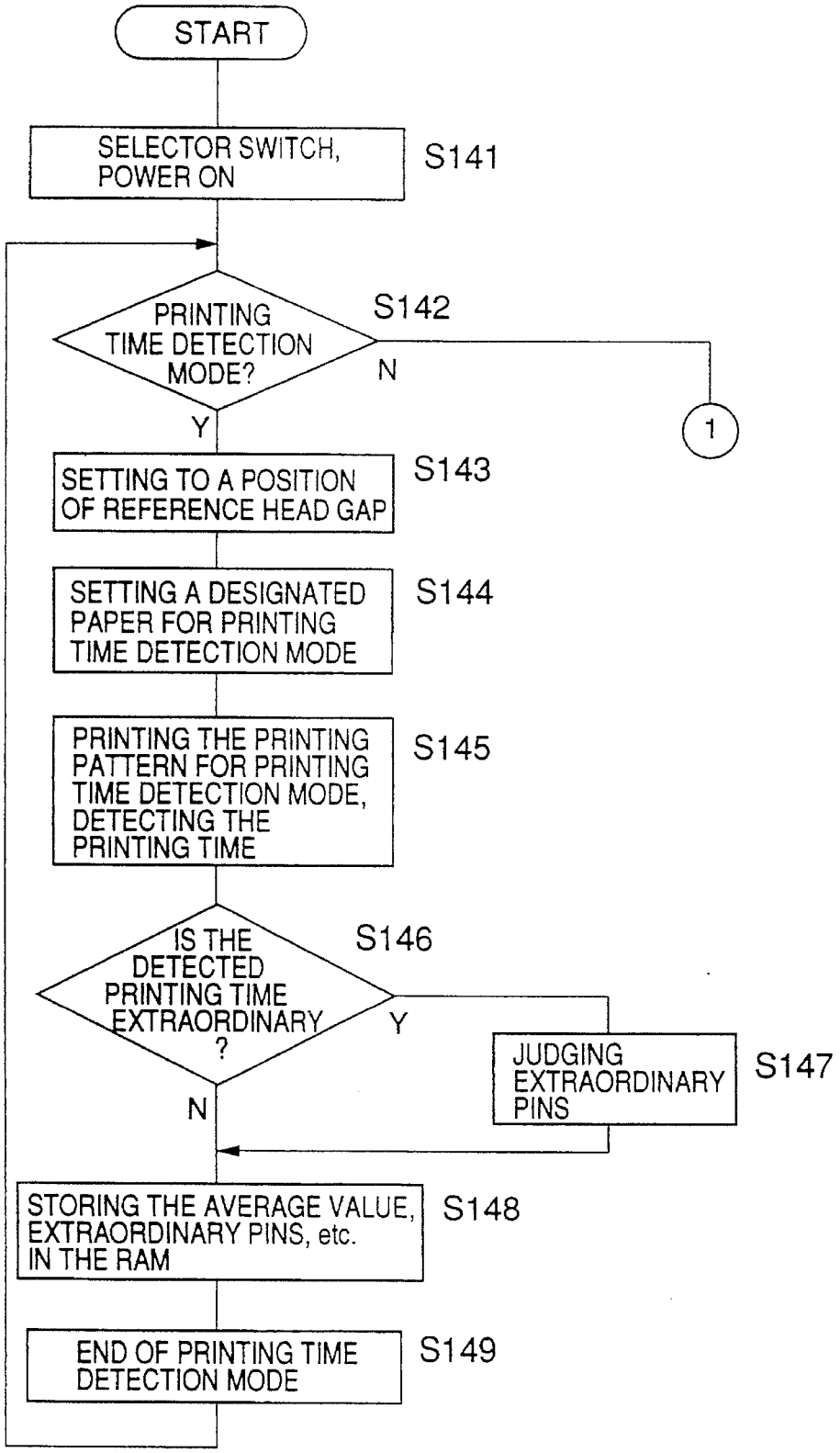
FIGS. 22 and 23 are flow charts showing a method of adjusting a head gap for a wire dot impact printer according to a sixth embodiment of the invention.
Figure 23:
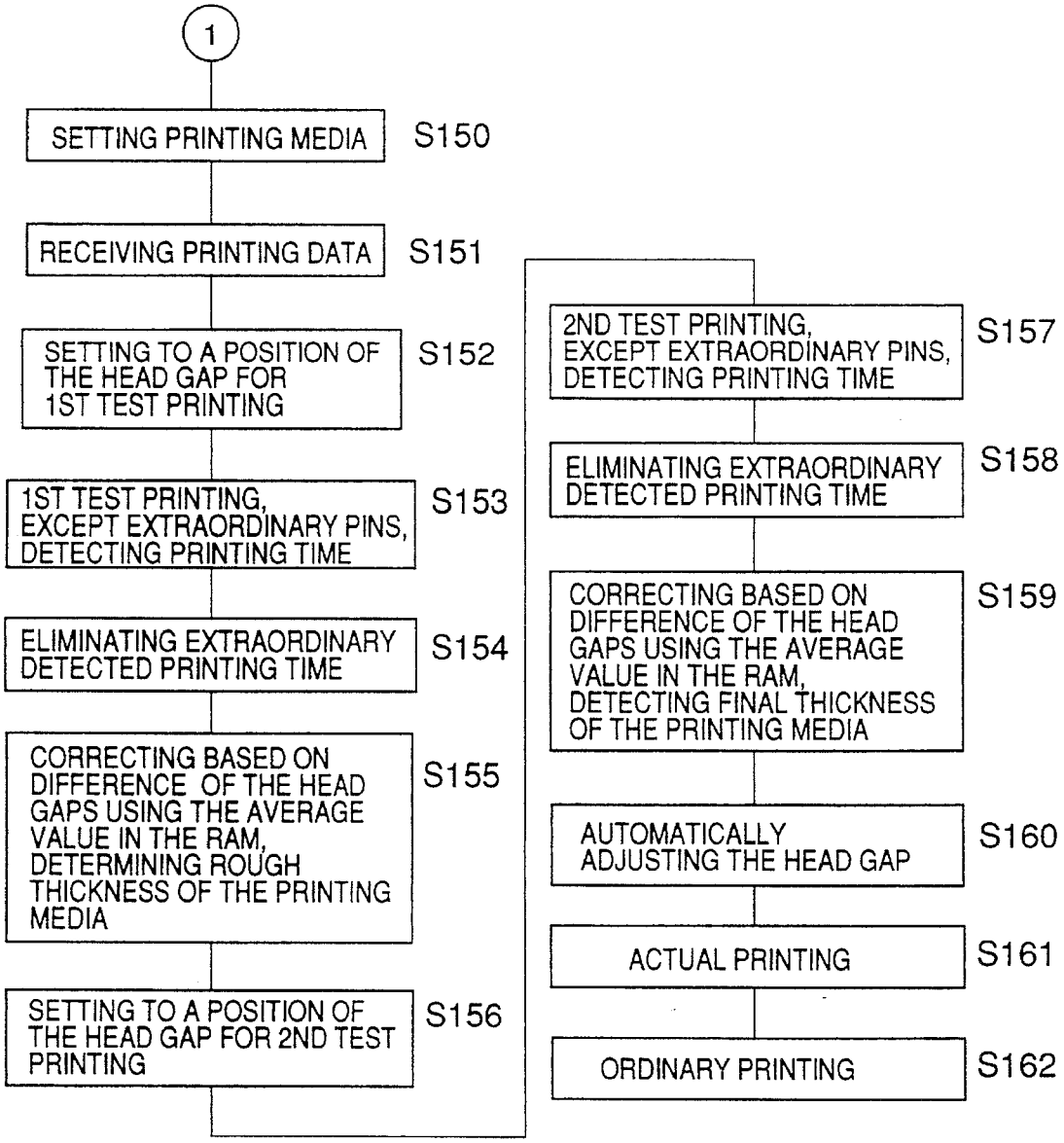

FIG. 22 is a first flow chart showing a method of adjusting a head gap for a wire dot impact printer according to the sixth embodiment of the invention; and FIG. 23 is a second flow chart showing a method of adjusting a head gap for a wire dot impact printer according to the sixth embodiment of the invention. In this embodiment, during the first test printing, the thickness of the printing media P is judged without the judgment (e.g., step S65) as to whether or not the dot number of the test printing is equal to or greater than n, which is at least required for a judgment of the thickness of the printing media P, and a head gap gC for the second test printing is set. During the second test printing, the final thickness of the printing media P is judged without the judgment (e.g., step S72) as to whether or not the dot number of the test printing is equal to or greater than m, which is at least required for a judgment of the thickness of the printing media P. Then, a shift amount of the wire dot head 4 is calculated for setting the head gap g to the optimum value gR in accordance with the thickness of the printing media P, and the head gap is automatically adjusted by driving the gap shifting means 15. The steps S141 to S162 are the same to the steps S81 to S94, steps S98 to S101, and steps S105 to S108 of the fourth embodiment, so the description for those steps is omitted.

It is to be noted that although in the third to sixth embodiments the printing time detection mode is selected by pushing down the selector switch 11 before the power of the wire dot impact printer is turned on, it is also possible that the printing time detection mode is selected by commands sent from the host computer after the power of the wire dot impact printer is turned on.

Next, a seventh embodiment of the invention will be described.

Figure 24:
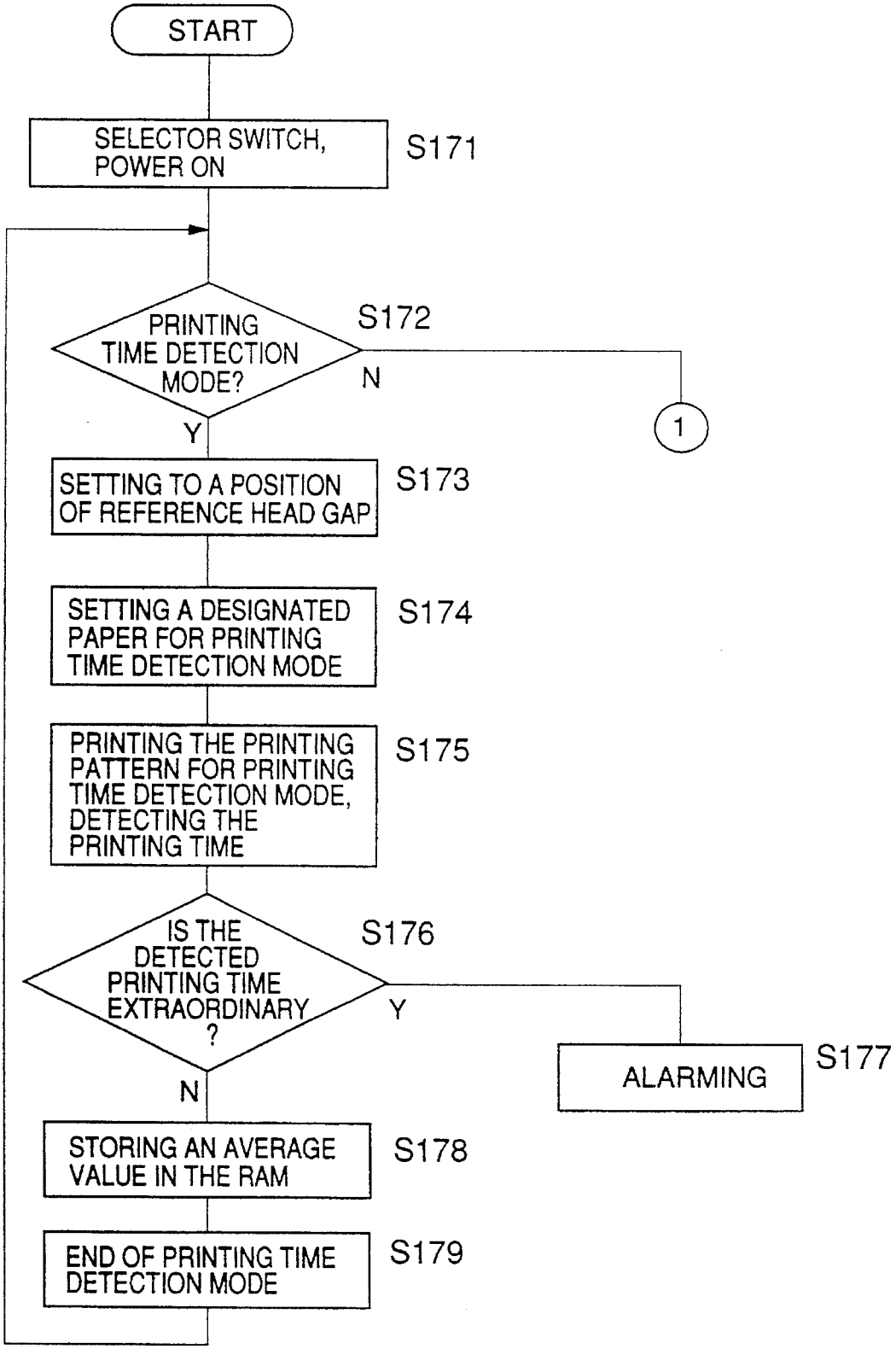
FIGS. 24, 25 and 26 are flow charts showing a method of adjusting a head gap for a wire dot impact printer according to a seventh embodiment of the invention.
Figure 25:
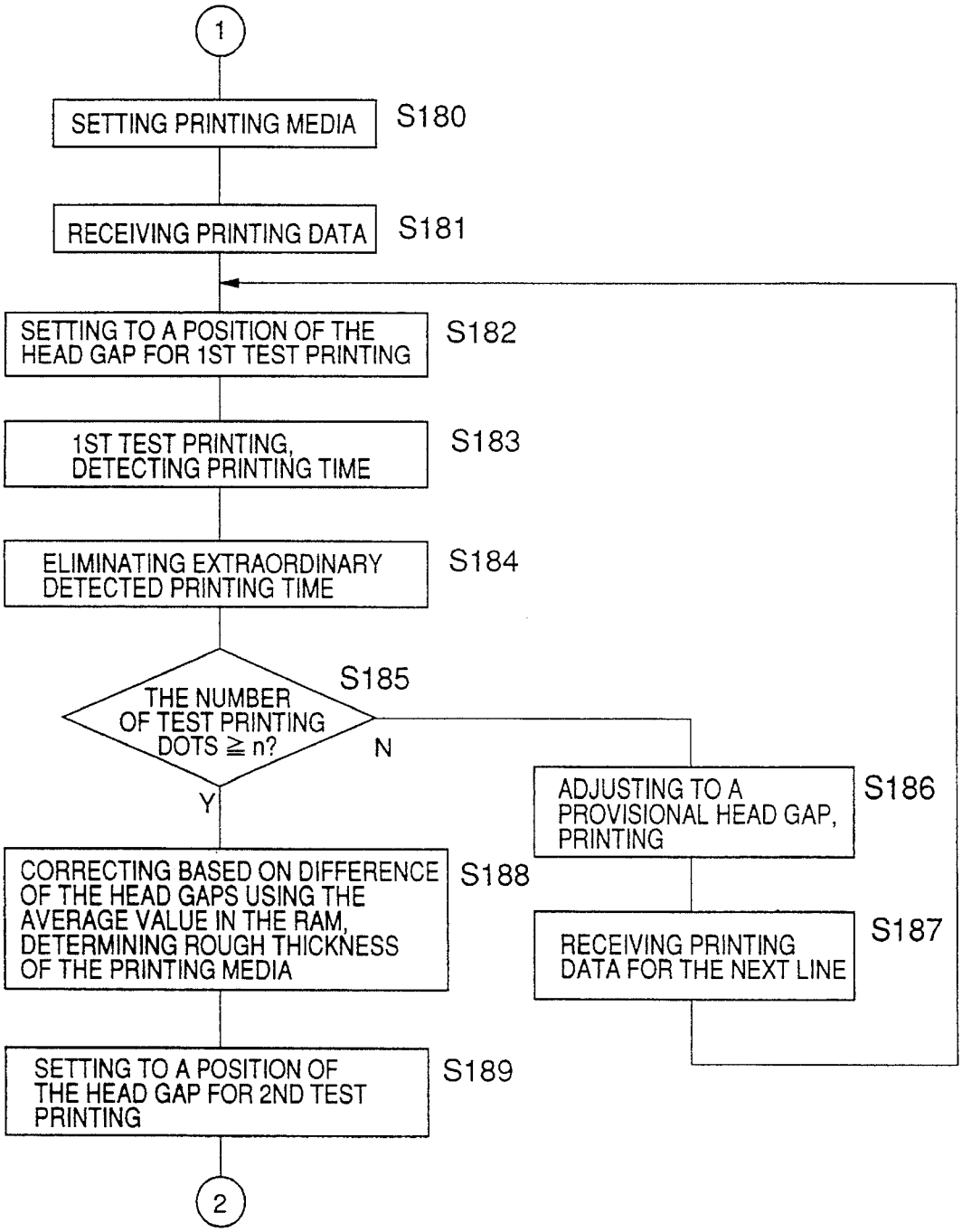
Figure 26:
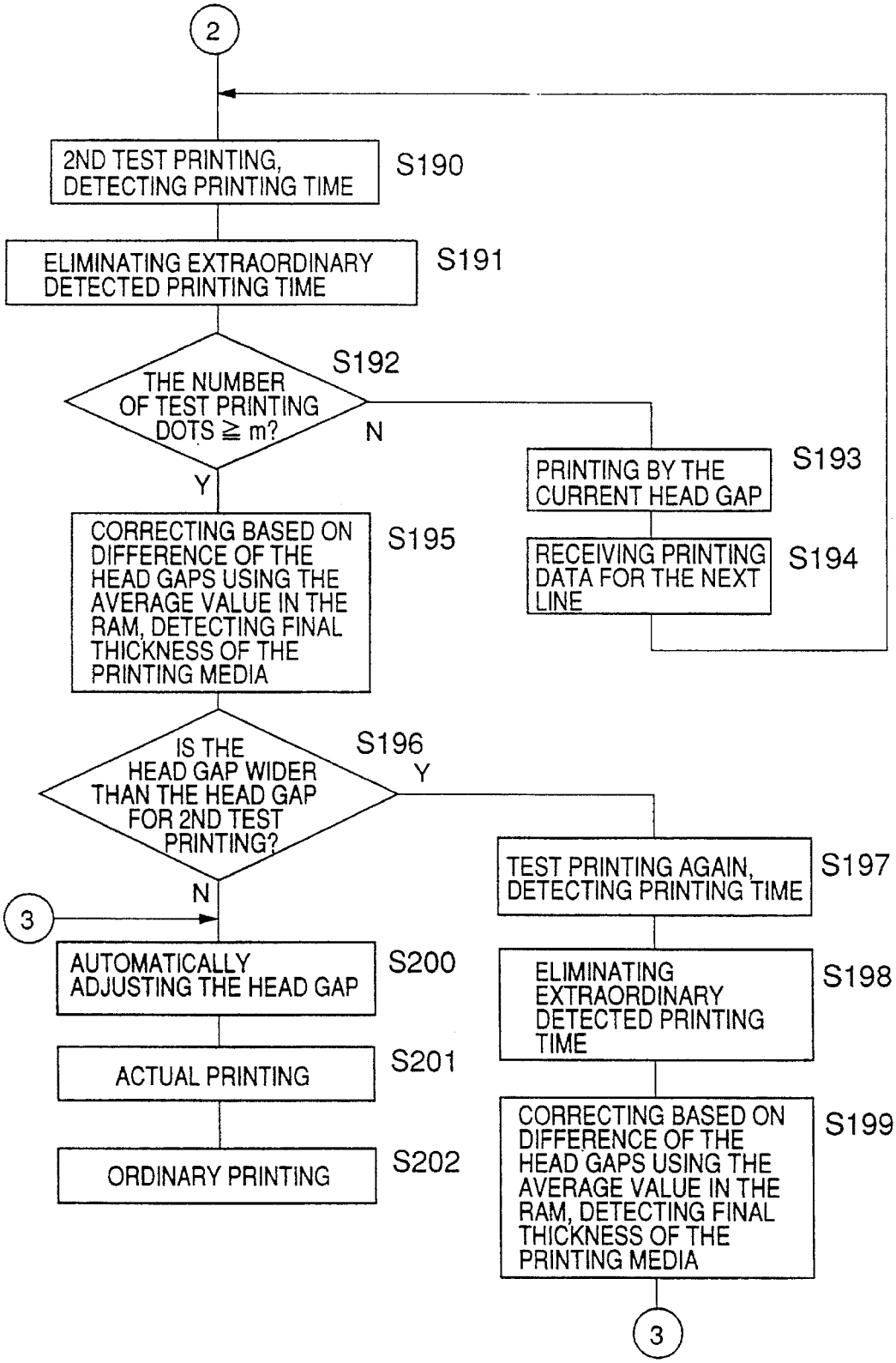

FIG. 24 is a first flow chart showing a method of adjusting a head gap for a wire dot impact printer according to the seventh embodiment of the invention; FIG. 25 is a second flow chart showing a method of adjusting a head gap for a wire dot impact printing according to the seventh embodiment of the invention; and FIG. 26 is a third flow chart showing a method of adjusting a head gap for a wire dot impact printer according to the seventh embodiment of the invention. The steps S171 to S195 are the same to the steps S51 to S75 of the third embodiment, so the description is omitted. At step S196 (FIG. 26), a judgment is made as to whether or not the calculated head gap g is broader than the head gap gC for the second test printing. If it is broader, the program goes to step S197. If it is narrower, the program goes to step S200. At step S197, since the result of the second test printing is doubtful, a third test printing is done, and the printing time T of the third test printing is detected. At step S198, extraordinary printing times, such as printing time of zero or an extremely long printing time (for instance 1 msec or above), are eliminated from the detected printing times T. At step 199, the difference between the average value $T_{PA}$ written in the RAM **2*d* during the printing time detection mode and the detected printing time T in this operation is calculated. Then, a correction is made based the difference between the reference head gap gA for printing time detection mode and the head gap gC for the second test printing. According to the relationship where a difference of printing time T of 3 μsec corresponds to a head gap g of 0.01 mm, the head gap g to the printing media P from the mounted wire dot head 4 is calculated, and the final thickness of the printing media P is judged. Then, the program goes to step S200. The steps S200 to S202 are the same to the steps S76 to S78** of the third embodiment, so the description for those steps is omitted.

Meanwhile, in the first to seventh embodiments, a speed waveform of the armature 32 is obtained by the differential of the output voltage $V_Q$ of the amplifier 54 (shown in FIG. 8) in the sensor circuit **10*b* (shown in FIG. 1) through the differential circuit 55, and the printing time T is determined by slicing the speed waveform with respect to a comparison voltage (hereinafter, called "slice level") of the comparator 56. However, if changes of magnetic characteristics of the material of the wire dot head 4**, or changes of the structure due to wear occur, the magnetic resistance in the magnet circuit changes and the printing time T also changes.

Figure 27:
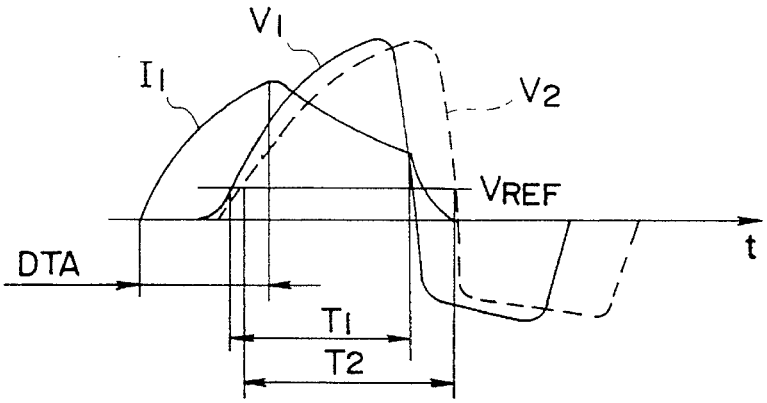
FIG. 27 is a time chart showing the condition of the waveform of the speed of an armature and printing speed when magnetic flux in a magnetic circuit is changed.

FIG. 27 is a time chart showing a condition of a speed waveform of the armature and printing time when the magnetic flux in the magnetic circuit changes. In FIG. 27, $I_1$ represents a current waveform flowing through the head coil **35*b* shown in FIG. 4; $V_1$ represents a speed waveform of the armature 32 before the magnetic flux changes; $V_2$ represents a speed waveform of the armature 32 after the magnetic flux changes; $V_{REF}$ represents the slice level; DTA represents a drive voltage applying time; $T_1$ represents printing time before the magnetic flux changes; and $T_2$ represents printing time after the magnetic flux changes. As shown in FIG. 27, if the magnetic resistance in the magnetic circuit becomes small and thereby reduces the magnetic flux, the speed waveform of the armature 32** changes from $V_1$ to $V_2$, and the printing time T changes from $T_1$ to $T_2$ becoming longer.

Figure 28:
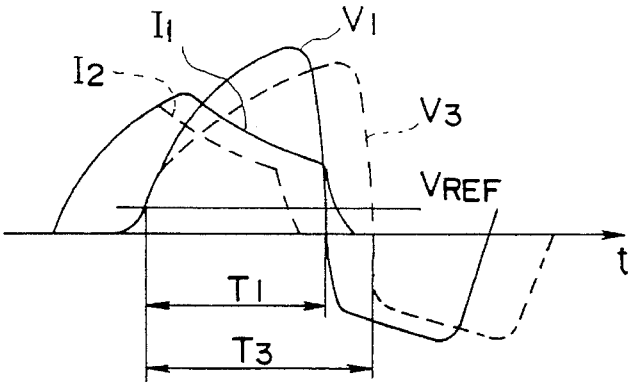
FIG. 28 is a time chart showing the condition of the waveform of the speed of an armature and printing speed when the applying time of drive voltage is changed.

FIG. 28 is a time chart showing a condition of a speed waveform of the armature and printing time when the drive voltage applying time changes. In FIG. 28, $I_1$ represents a current waveform flowing through the head coil **35*b* shown in FIG. 4 before the drive voltage applying time DTA (FIG. 27) changes; $I_2$ represents a current waveform flowing through the head coil 35*b* after the drive voltage applying time DTA changes; $V_1$ represents a speed waveform of the armature 32 before the drive voltage applying time DTA changes; $V_2$ represents a speed waveform of the armature 32 after the drive voltage applying time DTA changes; $V_{REF}$ represents the slice level; $T_1$ represents printing time before the drive voltage applying time DTA changes; and $T_2$ represents printing time after the drive voltage applying time DTA changes. As shown in FIG. 28**, if the drive voltage applying time DTA becomes short for some reasons, the printing time T changes from $T_1$ to $T_2$ becoming longer.

Figure 29:
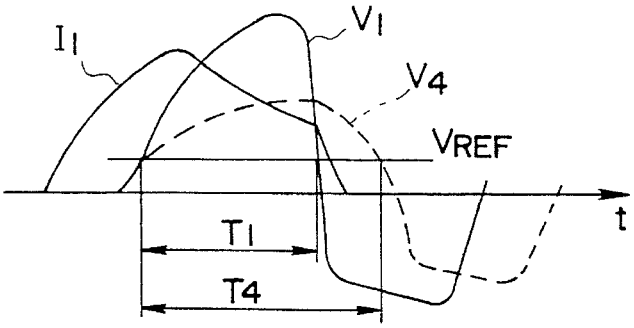
FIG. 29 is a time chart showing the condition of the waveform of the speed of an armature and printing speed when the hardness of the printing media is changed.

FIG. 29 is a time chart showing a condition of a speed waveform of the armature and printing time when the hardness of the printing media changes. In FIG. 29, $I_1$ represents a current waveform flowing through the head coil **35*b* shown in FIG. 4; $V_1$ represents a speed wave form of the armature 32 before the hardness of the printing media changes; $V_2$represents a speed wave form of the armature 32 after the hardness of the printing media changes; $V_{REF}$ represents the slice level; $T_1$ represents printing time before the hardness of the printing media changes; and $T_2$ represents printing time after the hardness of the printing media changes. For example, in the case when the printing media P is hard, as with drawing paper, and is not winding around the platen 25, is being floated, and contacting the front casing 31 of the wire dot head 4, the operations of the printing wire 30 and the armature 32 are restricted from the start of printing, thereby changing the speed waveform of the armature 32** from $V_1$ to $V_2$, and according to this, the printing time T changes from $T_1$ to $T_2$ and becomes longer.

Meanwhile, a head gap g, a speed v of the armature 32, and the printing time T are related as:

$$g = \int_0^T v \cdot dt \tag{1}$$

Where the speed v is approximately constant, the formula can be approximated to:

$$g = T \cdot v - \alpha \tag{2}$$

α: Constant

However, since the printing time T changes, as described above, according to changes such as the magnetic flux in the magnetic circuit, the drive voltage applying time DTA, and the hardness of the printing media, the relation between the head gap g and the printing time T becomes nonlinear. Consequently, the head gap g can not be calculated accurately.

Now, described will be an eighth embodiment of the invention in which: time between attracting of the armature 32 to the core **35*a* and returning of the armature 32** (hereinafter, called "returning time") is detected after printing is done; the thickness of the printing media P is judged based on the returning time; and the head gap g is calculated.

Figure 30:
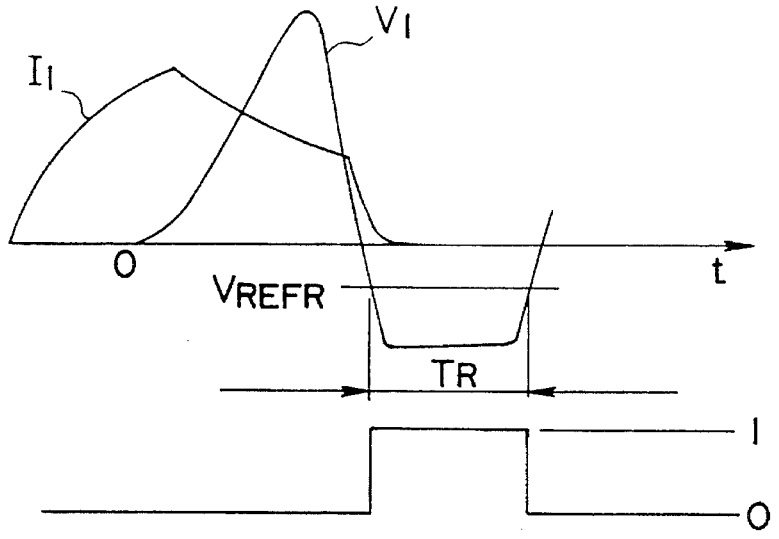
FIG. 30 is a flow chart showing a method of adjusting a head gap for a wire dot impact printer according to an eighth embodiment of the invention.

FIG. 30 is a time chart showing a condition of a speed waveform of the armature and returning time for a method of adjusting a head gap for a wire dot impact printer according to an eight embodiment of the invention. In FIG. 30, $I_1$ represents a current waveform flowing through the head coil 35*b* shown in FIG. 4; $V_1$ represents a speed waveform of the armature 32; $V_{REFR}$ represents a slice level provided in the speed waveform $V_1$ at which the armature 32 returns to the core 35*a*; and $T_R$ represents a "returning time." In this case, the speed wave form $V_1$ has a constant absolute value during the returning time $T_R$, and therefore, Formula (1) described above can be approximated by Formula (2) described above. That is, in the wire dot head 4, as described above using FIG. 4, the head coil 35*b* is energized when printing, thereby generating magnetic flux in a direction that the magnetic flux of the permanent magnet 37 is canceled, and thereby releasing the armatures 32 and the printing wires 30 attached to the plate spring 33. In the case where the armature 32 shifts by a certain distance, the relationship between attracting force $F_M$ of the magnetic flux generated by the permanent magnet 37 and elastic force $F_S$ generated by the plate spring 33 is controllable by adjusting the spring constant of the plate spring 33 and the magnetic field of the permanent magnet 37, and the speed v of the armature 32 can be relatively constant without receiving influences of the attracting force $F_M$ and the spring force $F_S$. When the printing wires 30 impact the platen 25 (shown in FIG. 3) through the printing media P, since the platen 25 is formed of a material having a small repulsive coefficient, such as rubber or the like, the repulsive force $F_R$ received by the printing wires 30 while impacting is about a constant force even if the thickness of the printing media P is changed.

Figure 31:
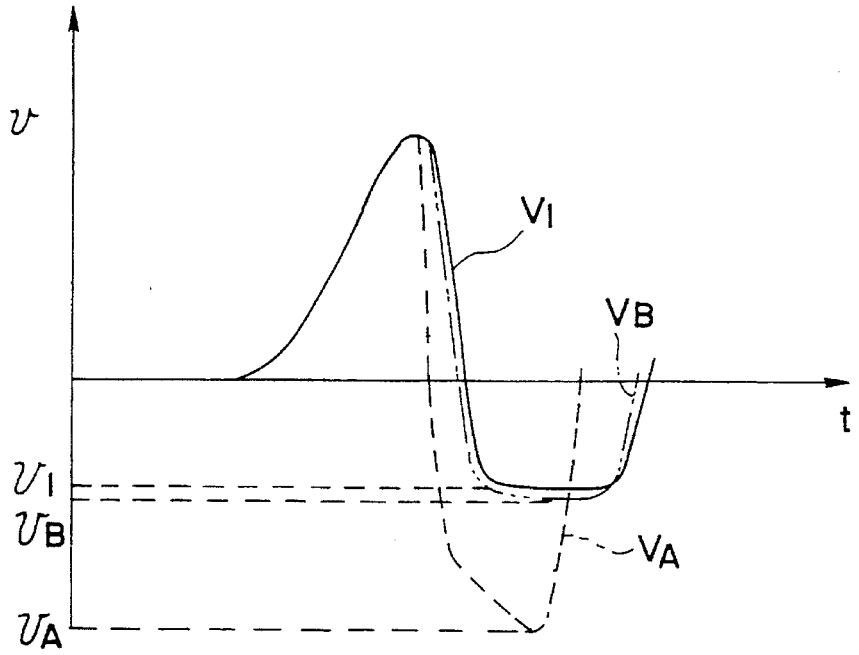
FIG. 31 is a diagram showing a comparison of returning speeds.

FIG. 31 is a diagram for comparison of the returning speeds. In FIG. 31, $V_1$ represents a speed waveform of the armature 32 when a rubber platen 25 shown in FIG. 3 is impacted with the printing wire 30 shown in FIG. 4 through the printing media P; $V_A$ represents a speed waveform of the armature 32 when a metal platen 25 is directly impacted with the printing wire 30; and $V_B$ represents a speed waveform of the armature 32 when a metal platen 25 is impacted with the printing wire 30 through the printing media P. $V_B$ also represents a speed waveform of the armature 32 when a rubber platen 25 is directly impacted with the printing wire 30. When the platen 25 is impacted with the printing wire 30, repulsive force $F_R$ forces the printing wire 30 back. At that time, as shown in FIG. 31, if the metal platen 25 is directly impacted with the printing wire 30, the returning speed $V_A$ at a time that the armature 32 is attracted by the core 35*a* and returned is high, whereas the returning speed $V_B$ is low when a thick printing media P is placed between the platen 25 and the printing wire 30, so that the returning speed $V_B$ is almost the same as the returning speed $V_1$ in the case of the rubber platen 25. The returning speed varies between $V_A$ and $V_B$ in accordance with the thickness of the printing media P, thereby affecting the speed v of the armature 32 in the returning period. On the other hand, the returning speed $V_B$ in the case when the rubber platen 25 is directly impacted with the printing wire 30 is almost the same as the returning speed $V_1$ in the case when the printing media P intermediates. That is, in the case of the rubber platen 25, the thickness of the printing media P does not change the returning speed. As a result, although the printing wire 30 is affected by the attracting force $F_M$, the spring force $F_S$, and the repulsive force $F_R$ through impact at the time of printing, the speed v of the armature 32 can be approximately constant by forming the platen 25 of a material with a small repulsive coefficient. On the other hand, the printing time T is affected by magnetic force Fc generated by the current fed to the head coil 35*b*, in addition to the attracting force $F_M$ and the spring force Fs. Since produced by a transitional current flowing the head coil 35*b*, the magnetic canceling force Fc changes in a nonlinear manner corresponding to the transitional increasing rate. Furthermore, the magnetic canceling force Fc affects the speed v of the armature 32 more than the attracting force $F_M$ or the spring force Fs. Accordingly, the operations of the armature 32 and the printing wire 30 become nonlinear. Since the speed v of the armature 32 during the returning time $T_R$ is lower than the speed v of the armature 32 during the printing time T, the time required of the printing wire 30 to shift across the same head gap g becomes longer, so that as a detection region, or a dynamic range, of the returning time $T_R$ becomes broader, the detection is done with high accuracy. That is, since a material having a small repulsive coefficient, such as rubber or the like, is used for the platen 25, the speed v of the armature 32 is reduced after the armature 32 (through wire 30) impacts the platen 25. Accordingly, the speed v of the armature 32 during the returning time $T_R$ is reduced than that before the armature 32 impact, so that the required time for the printing wire 30 to shift across the head gap g becomes longer than printing time T.

Figure 32:
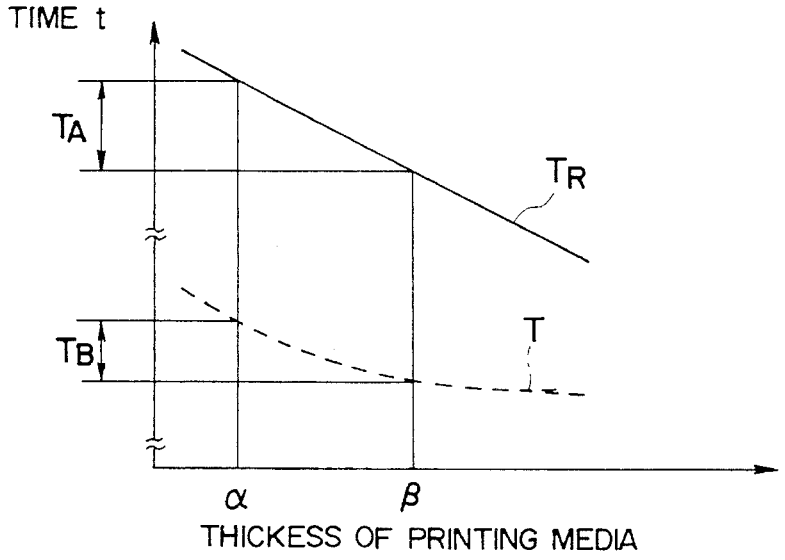
FIG. 32 is a diagram showing the relationship among thickness of printing media, printing time, and returning time.

FIG. 32 is a diagram of a relationship among thickness of printing media, printing time, and returning time. The abscissa is for the thickness of the printing media P, and the ordinate is for time T. In FIG. 32, T represents the printing time; and $T_R$ represents returning time. As shown in FIG. 32, if the thickness of the printing media P changes between α and α, the printing time T changes in a range $T_B$. In this whereas the returning time $T_R$ changes in a range $T_A$. In this case, since:

$$T_A > T_B,$$

the detection region of the returning time $T_R$ becomes broad, so that the detection is done with high accuracy. Disturbances, such as changes of the magnetic characteristics of the wire dot head 4 and changes of the drive voltage applying time DTA, have little influences on detection of the returning time $T_R$, so that results of the thickness of the printing media P can be calculated stably. That is, as described above, the printing time T is affected by the attracting force $F_M$, the spring force Fs, the repulsive force $F_R$, and the magnetic canceling force Fc, whereas the returning time $T_R$ is affected by the attracting force $F_M$, the spring force Fs, the repulsive force $F_R$, and not by the magnetic canceling force Fc. Accordingly, influence of the disturbances is suppressed. Although floating of the printing media P does affect the printing time T until the printing media P is pushed on the platen 25, the floating of the printing media P does not affect the returning time $T_R$ after the printing media P has been pushed because the printing wire 30 is returned by an almost constant repulsive force $F_R$. Moreover, even though some nonlinearity may exist, the thickness of the printing media P is judged based on the printing and returning time $T_T$ composed of the printing time T and the returning time $T_R$, as well as the head gap g is calculated, in order to detect with high accuracy.

Figure 33:
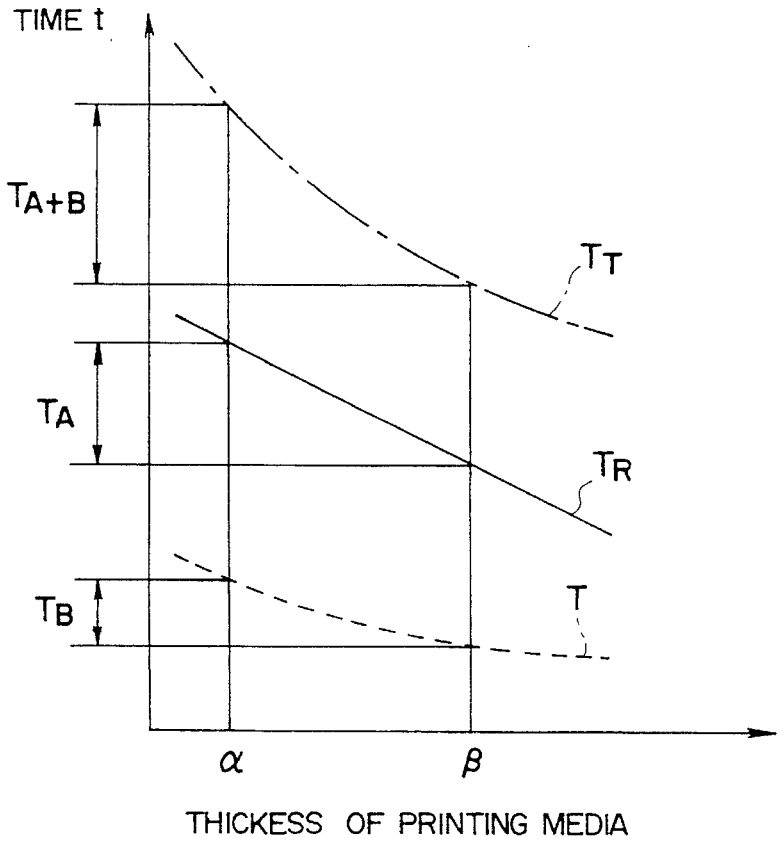
FIG. 33 is a diagram showing the relationship among thickness of printing media, printing time, returning time, printing and returning time.

FIG. 33 is a diagram of a relationship among thickness of the printing media, printing time, returning time, and printing and returning time. The abscissa is for thickness of the printing media P (shown in FIG. 4), and the ordinate is for time t. In FIG. 33, T represents the printing time; $T_R$ is the returning time; and $T_T$ is the printing and returning time. As shown in FIG. 33, if the thickness of the printing media P changes between α and β, the printing time T changes in a range $T_B$ and the returning time $T_R$ changes in a range $T_A$, whereas the printing and returning time $T_T$ changes in a range $T_A$+B. Though the printing and returning time $T_T$ assumes some nonlinear changes, since:

$T_A+B>T_A>T_B$, the detection region of the printing and returning time $T_T$ becomes broad, so that the detection is done with high accuracy. Furthermore, setting the slice level $V_{REF}$ to a higher level than an original point of the speed was form allows detection of the float of the printing media P.

Figure 34:
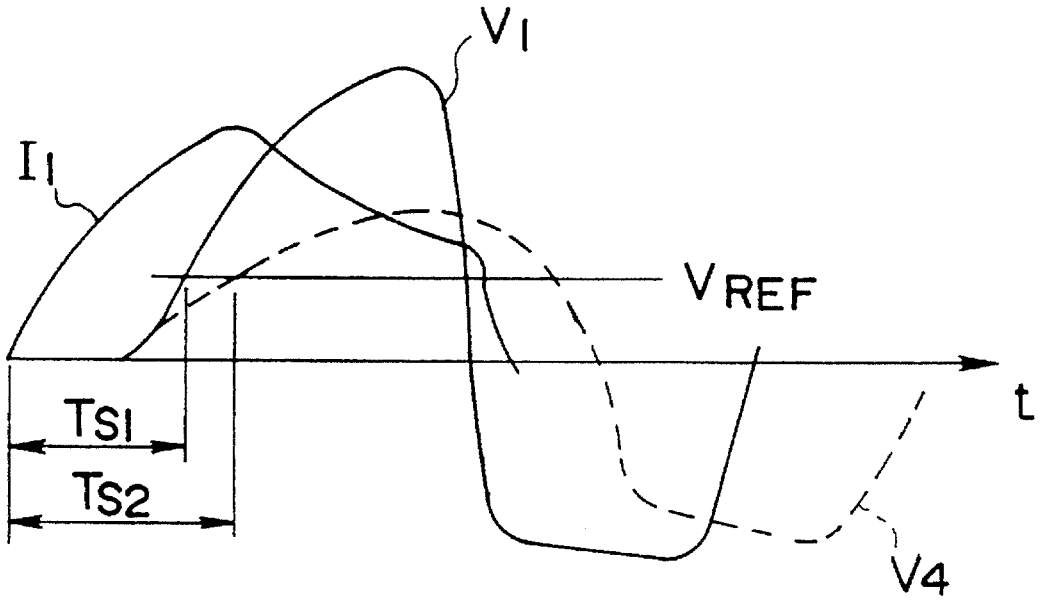
FIG. 34 is a time chart showing the waveform of the speed of an armature and the condition of printing speed when hardness of printing media is changed.

FIG. 34 is a time chart showing a condition of the speed waveform of the armature and the printing time when the hardness of the printing media P is changed. In FIG. 34, $I_1$ represents a current waveform flowing through the head coil 35*b* shown in FIG. 4; $V_1$ represents a speed waveform of the armature 32 before the hardness of the printing media changes; $V_4$ represents a speed waveform of the armature 32 when the printing media is hard and floated without winding the platen 25; $V_{REF}$ represents the slice level; $T_{S1}$ represents operation time from start of application of the drive voltage to a time that the speed v of the armature 32 reaches a value of a point at which the speed waveform $V_1$ crosses the slice level $V_{REF}$; and $T_{S2}$ represents operation time from start of application of the drive voltage to a time that the speed v of the armature 32 reaches a value of a point at which the speed waveform $V_4$ crosses the slice level $V_{REF}$. Accordingly, the floating condition of the printing media P can be detected by the difference between the operation times $T_{S1}$, $T_{S2}$.

It is to be noted that the invention is not restricted to the embodiments described above, and that various modifications may occur based on the nature of the invention. Such modifications are not eliminated from the scope of the invention.

As described in detail above, in the method of adjusting a head gap for a wire dot impact printer according to the invention, the wire dot head is set to a position of a predetermined head gap; a printing pattern for detection of printing time is printed by a plurality of pins; standard printing times of respective pins are detected. Next, a test printing is done according to previously selected test printing dots using printing data, and printing time of the test printing is detected. Then, the thickness of the printing media is calculated based on the standard printing times and the printing time of the test printing. In this case, a rule of thumb that the difference between the printing times corresponds to the difference of positions of the head gap, is used. Then, a shift amount of the wire dot head for setting the head gap to an optimum value in accordance with the thickness of the printing media is calculated, and the wire dot head is shifted with gap shifting means by the shift amount. Accordingly, the optimum value of the head gap according to the characteristics of the wire dot head can be obtained automatically, and therefore, this improves printing quality thereof.

In another aspect of the invention, after the standard printing time is detected, the first and second test printing are done. That is, the wire dot head is set to a position of a head gap for the first test printing, which is set so as to be relatively broad, and then, the first printing is done. After the first printing, the printing time of the first test printing is detected, and then, a rough thickness of the printing media is calculated based on the standard printing time and the printing time of the first test printing. Then, a head gap for the second test printing, which is narrower than the head gap for the first test printing, is set according to the rough thickness of the printing media. The wire dot head is set to a position of the head gap for the second test printing, and then, the second test printing is done to detect the printing time of the second test printing. More accurate thickness of the printing media is then calculated based on the standard printing time and the printing time of the second test printing. Then, a shift amount of the wire dot head for setting the head gap to an optimum value in accordance with the thickness of the printing media is calculated, and the wire dot head is shifted by the shift amount. Thus, since a broad head gap for the first test printing is set in the case of the first test printing and a narrow head gap for the second test printing is set in the case of the second test printing, the printing time is detected with high accuracy. Furthermore, when the first test printing is done, the surface of the printing media P does not becomes ugly because the head gap gB for the first test printing to be set is broad. When the second test printing is done, the surface of the printing media P does not becomes ugly because the head gap gC for the second test printing is set based on the rough thickness of the printing media P even though the head gap gC for the second test printing to be set is narrow.

In another aspect of the invention, a printing pattern is printed for detecting the printing time by a plurality of pins; standard printing times of respective pins are detected; an average value of the detected printing times is calculated to be stored in a memory.

At that time, the average value of the detected printing times is stored in the memory as a standard printing time. Next, a test printing is done, and a printing time of the test printing is detected. The thickness of the printing media is then calculated based on the average value of the printing time and the printing time of the test printing.

According to yet another aspect of the invention, extraordinary printing times, such as printing times equal to zero or extremely long, are eliminated among the detected printing time obtained during the test printing, and the thickness of the printing media is calculated. Moreover, the thickness of the printing media can be calculated only when the dot number of the test printing is equal to or greater than a predetermined value. Therefore, since, extraordinary printing times, such as printing times equal to zero or extremely long, are eliminated among the detected printing time, the head gap is always properly set. Furthermore, the thickness of the printing media is not calculated when the dot number of the test printing is less than a predetermined value, the printing times are detected with high accuracy.

In accordance with further aspects of the invention, speed of an armature is detected, and returning time of printing wires is detected by speed waveform of the detected speed and by a predetermined slice level. According to returning time, the thickness of the printing media is calculated. The returning time is not affected by changes of magnetic characteristics, so that the calculation results of the thickness of the printing media become stable. Since the detection region of the returning time becomes broad, the detection is done with high accuracy. In this case, it is possible to calculate based on the printing time and the returning time after the printing time and returning time of printing wires are detected by speed waveform of the detected speed and a predetermined slice level.

It is understood that although the present invention has been described in detail with respect to preferred embodiments thereof, various other embodiments and variations are possible to those skilled in the art which fall within the scope and spirit of the invention, and such other embodiments and variations are intended to be covered by the following claims.

What is claimed is:

1. A method of adjusting a head gap for a wire dot impact printer having a wire dot head with a plurality of printing wires, predetermined ones of the printing wires having sensors associated therewith at which voltage varies based on displacement of the associated printing wire, said method comprising the steps of:

(a) setting a wire dot head to a predetermined reference head gap position;

(b) printing a printing pattern onto a predetermined printing media, a printing time thereof being previously known, by a plurality of printing wires provided at said wire dot head;

(c) detecting with the sensors reference printing time information based on the printing;

(d) setting said wire dot head to said predetermined reference head gap position, performing a test printing onto a test printing media, the printing time thereof to be determined, the thickness of the test printing media and that of a printing media for actual printing being the same, and detecting with the sensors printing time information of said test printing;

(e) calculating a shift amount of the wire dot head for shifting said head gap to an optimum value based on said reference printing time information and said printing time information of said test printing; and (f) shifting said wire dot head by said shift amount.

2. A method of adjusting a head gap for a wire dot impact printer as set forth in claim 1, wherein all printing wires of the wire dot head have sensors, and further comprising the step of informing an extraordinary status to an operator of said wire dot impact printer when said reference printing time information detected with the sensors at all of the printing wires includes extraordinary printing time information.

3. A method of adjusting a head gap for a wire dot impact printer as set forth in claim 2, wherein all printing wires of the wire dot head have sensors, and wherein said step of informing an extraordinary status to said operator comprises activating an alarm.

4. A method of adjusting a head gap for a wire dot impact printer as set forth in claim 1, wherein all printing wires of the wire dot head have sensors, and further comprising the step of, in the case when said reference printing time information detected with the sensors at all of the printing wires includes extraordinary printing time information, eliminating said extraordinary printing time information and calculating the shift amount of the wire dot head using ordinary printing time information except said extraordinary printing time information.

5. A method of adjusting a head gap for a wire dot impact printer having a wire dot head with a plurality of printing wires, predetermined ones of the printing wires having sensors associated therewith at which voltage varies based on displacement of the associated printing wire, and having a printing time detection mode for detecting a reference printing time and an ordinary printing mode, said method comprising the steps of:

(a) setting said wire dot impact printer to said printing time detection mode;

(b) setting a wire dot head to a predetermined reference head gap position;

(c) printing a printing pattern onto a predetermined printing media, a printing time thereof being previously known, by a plurality of printing wires provided at said wire dot head;

(d) detecting with the sensors reference printing time information of respective of said printing wires based on the printing;

(e) sorting an average value of said reference printing time information of respective of said printing wires;

(f) setting said wire dot impact printer to said ordinary printing mode;

(g) setting said wire dot head to said predetermined reference head gap position, performing a test printing onto a test printing media, the printing time thereof to be determined, the thickness of the test printing media and that of a printing media for actual printing being the same, and detecting with the sensors printing time information of said test printing;

(h) calculating a shift amount of the wire dot head for shifting said head gap to an optimum value based on said average value of said printing time information and said printing time information of said test printing; and (i) shifting said wire dot head by said shift amount.

6. A method of adjusting a head gap for a wire dot impact printer as set forth in claim 5, wherein all printing wires of the wire dot head have sensors, and further comprising the step of informing an extraordinary status to an operator of said wire dot impact printer when said reference printing time information detected with the sensors at all of the printing wires includes extraordinary printing time information.

7. A method of adjusting a head gap for a wire dot impact printer as set forth in claim 6, wherein all printing wires of the wire dot head have sensors, and wherein said step of informing an extraordinary status to said operator comprises activating an alarm.

8. A method of adjusting a head gap for a wire dot impact printer as set forth in claim 5, wherein all printing wires of the wire dot head have sensors, and further comprising the step of, in the case when said reference printing time information detected with the sensors at all of the printing wires includes extraordinary printing time information, eliminating said extraordinary printing time information and calculating the shift amount of the wire dot head using ordinary printing time information except said extraordinary printing time information.

9. A method of adjusting a head gap for a wire dot impact printer having a wire dot head with a plurality of printing wires, predetermined ones of the printing wires having sensors associated therewith at which voltage varies based on displacement of the associated printing wire, said method comprising the steps of:

(a) setting a wire dot head to a predetermined reference head gap position;

(b) printing a printing pattern on a first printing media by a plurality of printing wires provided at said wire dot head;

(c) detecting with the sensors reference printing time information based on the printing;

(d) setting said wire dot head to a predetermined first printing head gap position;

(e) performing a first test printing on a second printing media which is the same kind of media as the first printing media, and detecting with the sensors first printing time information of said first test printing;

(f) calculating rough thickness of the second printing media based on said reference printing time information and said first printing time information;

(g) determining a second printing head gap narrower than said first printing head gap according to said rough thickness of said second printing media;

(h) setting said wire dot head to a said second printing head gap position;

(i) performing a second test printing on a third printing media which is the same kind of media as the first printing media and the second printing media, and detecting with the sensors second printing time information of said second test printing;

(j) calculating thickness of said third printing media based on said reference printing time information and said second printing time information;

(k) calculating a shift amount of said wire dot head for shifting said head gap to an optimum value according to said thickness of said third printing media; and (l) shifting said wire dot head by said shift amount.

10. A method of adjusting a head gap for a wire dot impact printer as set forth in claim 9, wherein all printing wires of the wire dot head have sensors, and further comprising the step of, in the case when said reference printing time information detected with the sensors includes extraordinary printing time information, eliminating said extraordinary printing time information and subsequently calculating said second printing media rough thickness and said third printing media thickness using ordinary printing time information except said extraordinary printing time information.

11. A method of adjusting a head gap for a wire dot impact printer as set forth in claim 9, further comprising the step of, in the case when the value of ordinary printing time information is less than a predetermined number, setting a provisional head gap to print.

12. A method of adjusting a head gap for a wire dot impact printer as set forth in claim 9, further comprising the step of, in the case when the printing time information obtained by detection of said reference printing time information includes extraordinary printing time information, storing information indicating which printing wires output said extraordinary printing time information, printing with said printing wires except printing wires which had outputted said extraordinary printing time information in said first test printing and said second test printing; and calculating the rough thickness of said second printing media and the thickness of said third printing media based on detected printing time information except information from said printing wires which had outputted said extraordinary printing time information.

13. A method of adjusting a head gap for a wire dot impact printer as set forth in claim 9, further comprising the step of, in the case when said first head gap is compared with said second head gap and said second head gap is broader than said first head gap, performing a test printing again, calculating the thickness of said printing media according to detected printing time information based on said test printing, and shifting said wire dot head according to the calculated result.

14. A method of adjusting a head gap for a wire dot impact printer, said method comprising the steps of:

(a) detecting speed of an armature during movement of the armature and producing a speed wave form;

(b) detecting returning time of a printing wire based on said speed wave form of said detected speed and on a predetermined slice level;

(c) calculating the thickness of printing media based on said returning time;

(d) calculating a shift amount of the wire dot head for shifting said head gap to an optimum value according to said thickness of said printing media; and (e) shifting said wire dot head by said shift amount.

15. A method of adjusting a head gap for a wire dot impact printer, said method comprising the steps of:

(a) detecting speed of an armature during movement of the armature and producing a speed wave form;

(b) detecting printing time and returning time of a printing wire based on said speed wave form of said detected speed and on a predetermined slice level;

(c) calculating thickness of printing media based on said printing time and said returning time;

(d) calculating a shift amount of the wire dot head for shifting said head gap to an optimum value according to said thickness of said printing media; and (e) shifting said wire dot head by said shift amount.

* * * * *